US011024980B2

(12) United States Patent
Vollmer et al.

(10) Patent No.: US 11,024,980 B2
(45) Date of Patent: Jun. 1, 2021

(54) DUAL-POLARIZED ANTENNA

(71) Applicant: Telefonaktiebolaget LM Ericsson (publ), Stockholm (SE)

(72) Inventors: Andreas Vollmer, Rosenheim (DE); Manfred Stolle, Bad Aibling (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 108 days.

(21) Appl. No.: 15/756,416

(22) PCT Filed: Aug. 31, 2016

(86) PCT No.: PCT/EP2016/001472
§ 371 (c)(1),
(2) Date: Jul. 23, 2018

(87) PCT Pub. No.: WO2017/036599
PCT Pub. Date: Mar. 9, 2017

(65) Prior Publication Data

US 2018/0337462 A1 Nov. 22, 2018

(30) Foreign Application Priority Data

Sep. 1, 2015 (DE) ..... 10 2015 011 426

(51) Int. Cl.
*H01Q 21/26* (2006.01)
*H01Q 9/16* (2006.01)
(Continued)

(52) U.S. Cl.
CPC ..... *H01Q 21/26* (2013.01); *H01Q 1/246* (2013.01); *H01Q 9/16* (2013.01); *H01Q 13/10* (2013.01); *H01Q 1/364* (2013.01)

(58) Field of Classification Search
CPC ..... H01Q 21/26; H01Q 1/246; H01Q 9/16; H01Q 13/10; H01Q 1/364; H01Q 9/26; H01Q 11/10; H01Q 21/30
(Continued)

(56) References Cited

U.S. PATENT DOCUMENTS 6,034,649 A 3/2000 Wilson et al.
6,229,496 B1 * 5/2001 Eriksson ..... H01Q 1/246 343/789
(Continued)

FOREIGN PATENT DOCUMENTS

AU 2011202962 A1 1/2012
DE 19823749 C2 7/2002
(Continued)

OTHER PUBLICATIONS

Li, M. et al., "Wideband Magnetoelectric Dipole Antennas With Dual Polarization and Circular Polarization," IEEE Antennas and Propagation Magazine, vol. 57, No. 1, Feb. 20, 2015, 10 pages.
(Continued)

*Primary Examiner* — Hai V Tran
(74) *Attorney, Agent, or Firm* — Withrow & Terranova, PLLC

(57) ABSTRACT

The invention relates to a dual-polarized antenna having four dipole elements which are each provided on an associated support element, wherein a slot extends in the volume of each dipole element and is prolonged from the dipole element into the associated support element.

19 Claims, 18 Drawing Sheets

(51) Int. Cl.
*H01Q 13/10* (2006.01)
*H01Q 1/24* (2006.01)
*H01Q 1/36* (2006.01)

(58) Field of Classification Search
USPC ..... 343/727
See application file for complete search history.

(56) References Cited

U.S. PATENT DOCUMENTS 6,317,099 B1 * 11/2001 Zimmerman ..... H01Q 1/246 343/747
6,333,720 B1 12/2001 Göttl et al.
6,650,301 B1 * 11/2003 Zimmerman ..... H01Q 1/246 343/803
7,692,601 B2 * 4/2010 Bisiules ..... H01P 5/103 343/797
2002/0163476 A1 11/2002 Eriksson
2002/0163477 A1 * 11/2002 Eriksson ..... H01Q 1/246 343/815
2003/0231138 A1 * 12/2003 Weinstein ..... H01Q 9/065 343/795
2005/0253769 A1 * 11/2005 Timofeev ..... H01Q 1/246 343/797
2008/0204343 A1 * 8/2008 Kildal ..... H01Q 11/10 343/792.5
2013/0307743 A1 11/2013 Moon et al.
2015/0162665 A1 * 6/2015 Boryssenko ..... H01Q 9/26 343/797

FOREIGN PATENT DOCUMENTS

EP 0685900 A1 12/1995
EP 1772929 A1 4/2007
EP 2529448 B1 12/2012
EP 2851996 A1 3/2015
WO 0039894 A1 7/2000
WO 2008017386 A1 2/2008
WO 2013143364 A1 10/2013

OTHER PUBLICATIONS

ISA European Patent Office, International Search Report Issued in Application No. PCT/EP2016/001472, dated Nov. 30, 2016, WIPO, 5 pages.
The Second Office Action for Chinese Patent Application No. 201680064052.2, dated Mar. 4, 2020, 12 pages.
The Third Office Action for Chinese Patent Application No. 201680064052.2, dated Aug. 5, 2020, 9 pages.
Fourth Office Action for Chinese Patent Application No. 201680064052.2, dated Jan. 21, 2021, 9 pages.
Examination Report for European Patent Application No. 16759682.4, dated Jan. 22, 2021, 9 pages.

* cited by examiner

DUAL-POLARIZED ANTENNA

CROSS-REFERENCE TO RELATED APPLICATION

The present application is a U.S. National Phase of International Patent Application Serial No. PCT/EP2016/001472, entitled "DUAL-POLARIZED ANTENNA," filed on Aug. 31, 2016. International Patent Application Serial No. PCT/EP2016/001472 claims priority to German Patent Application No. 10 2015 011 426.3, filed on Sep. 1, 2015. The entire contents of each of the abovementioned applications are hereby incorporated by reference in their entirety for all purposes.

TECHNICAL FIELD

The present invention relates to a dual polarized antenna having four dipole elements of which each is arranged at an associated support element. The dipole elements can here be dipole halves of which two respective ones together form a dipole of the antenna. In this respect, two respective dipole elements disposed opposite with respect to the center axis of the antenna form a dipole, with the polarization planes of these two dipoles extending orthogonally to one another.

BACKGROUND AND SUMMARY

Such a dual polarized antenna is known, for example, from EP 2 050 164 B1. The dipole elements shown there are designed as planar, with each dipole element taking up a quadrant of the antenna.

Respective dual polarized antennas in accordance with the category are known from WO 00/39894 A1 and EP 1 772 929 A1, in which the dipole elements each comprise two separate sections that are arranged symmetrically to the polarization plane of the dipole, that are arranged at a common support element, and that are fed via it. A short gap is provided between the outer ends of the two sections in some embodiments.

Documents U.S. Pat. No. 6,034,649, EP 6 859 00 B1 and US 2013/0307743 A1 likewise show dual polarized antennas having four dipole elements. In accordance with US 2013/0307743 A1, a single dipole element can comprise two sections that are held at a common support element and are fed by it.

A dual polarized antenna is furthermore known from the article Mingjian, Li, et al., Magnetoelectric Dipole Antennas With Dual Polarization and Circular Polarization, IEEE Antennas and Propagation Magazine, Volume 57, Number 1, February 2015, in which the dipole elements are formed by planar metal sheets that each take up a quadrant of the antenna and that are held at support elements. The feed takes place here via microstrip lines that extend in crossed form in the slots between the support elements.

It is the object of the present invention to provide an improved dual polarized antenna. The broadband capacity of the antenna should in particular be increased and the volume of the antenna should be used better.

This object is achieved in accordance with the invention by a dual polarized antenna comprising four dipole elements of which each is arranged at an associated support element, wherein a slot is provided in the volume of each dipole element and is extended from the dipole element into the associated support element. Advantageous embodiments of the invention form the subject of the dependent claims.

The present invention comprises a dual-polarized antenna having four dipole elements of which each is arranged at an associated support element. The dipole elements can here be dipole halves of which two respective ones together form a dipole of the antenna. In accordance with the invention, a slot is provided in the volume of each dipole element and is extended from the dipole element into the associated support element. The inventors of the present invention have recognized that the slot extending in accordance with the invention in the volume of the dipole elements and in associated support elements acts as an additional radiator and hereby enlarges the broadband capacity of the antenna and that the volume can be used better. The extension of the slot from the dipole element into the support element here enables a length of the slot that is sufficient for this purpose.

The present invention is in particular used with a dual polarized antenna in which two respective dipole elements disposed opposite with respect to a center axis of the antenna form a dipole. The four dipole elements are then four dipole halves of which two respective ones together form a dipole of the antenna. The polarization planes of the two dipoles of the antenna preferably extend orthogonally.

In a possible embodiment of the invention, the support elements and/or the dipole elements can have a fourfold rotational symmetry with respect to a center axis of the antenna. Alternatively or additionally, the support elements and/or the dipole elements can be arranged axially symmetrically with respect to a center axis of the antenna.

The antenna is here preferably designed such that the support elements extend from a pedestal of the antenna separately upwardly, with the dipole elements extending outwardly from the upper end of the support elements. The dipole elements are arranged at a defined spacing above the pedestal of the antenna by the support elements, with the antenna typically being fastened to the pedestal at a reflector. The support elements are preferably connected to one another mechanically and/or galvanically in the region of the pedestal.

The support elements can here in particular each extend substantially in parallel with a center axis of the antenna. The dipole elements preferably extend substantially along a plane that extends perpendicular to the center axis of the antenna.

In accordance with an embodiment of the present invention, the respective slot arranged in the volume of a dipole element and of the associated support element forms a slot radiator. In accordance with the present invention, dipole radiators and slot radiators can be combined in the antenna in accordance with the invention, with the slot radiators being arranged in the volume of the dipole radiators. A very compact arrangement and an effective use of the volume hereby results.

The polarization planes of the slot radiators preferably each stand perpendicular on the polarization plane of the dipole element in whose volume they are arranged. Alternatively or additionally, the polarization plane of a slot radiator can extend in parallel with the polarization plane of an adjacently arranged dipole element.

As already explained above, the extension of the slot from the dipole element into the support element in accordance with the invention permits a length of the slot that is advantageous for the radiation properties. The inventors of the present invention have recognized in this respect that the length of the slot in the dipole element and in the support element has a decisive influence on the radiation properties of the antenna in accordance with the invention.

The region of the slots extended into the support element preferably has a length, measured in each case from the upper edge of the antenna, of at least 0.1λ, with λ being the wavelength of the center frequency of the lowest resonant frequency range of the antenna. The slot in the support element preferably has a length of at least 0.15λ.

The slot in the support element furthermore preferably ends at a pedestal region of the antenna and therefore does not pass through the pedestal region. The lower end of the slot in the support element can in particular be formed by a base region which the pedestal of the antenna adjoins.

The region of the slots extending in the volume of the support elements further preferably has a length, respectively measured from the upper edge of the antenna up to the end of the slot, between 0.1λ and 0.4λ. λ is the wavelength of the center frequency of the lowest resonant frequency range of the antenna. The length here preferably amounts to between 0.15λ and 0.35λ.

The region of the slots extending in the volume of the dipole elements further preferably has a length, respectively measured from an inner edge of the slot up to an outer end or up to the outer edge of the dipole elements, between 0.1λ and 0.4λ. λ is here also the wavelength of the center frequency of the lowest resonant frequency range of the antenna. The length here preferably amounts to between 0.15λ and 0.35λ.

Alternatively or additionally, the slots extending in the volume of the support elements and of the dipole elements can each have a total length, measured along the radial outer edge of the support element and the upper edge of the dipole element, between 0.3λ and 0.7λ. λ is here also the wavelength of the center frequency of the lowest resonant frequency range of the antenna. The slots preferably each have a total length between 0.4λ and 0.6λ.

In a preferred embodiment of the present invention, the four support elements are also respectively separated from one another by slots. The slots between the support elements here preferably also have a length, respectively starting from the end of the slot in a pedestal region of the antenna up to the upper edge of the antenna, between 0.1λ and 0.4λ, preferably between 0.15λ and 0.35λ, with λ being the wavelength of the center frequency of the lowest resonant frequency range of the antenna.

Provision can furthermore be made in accordance with the invention that the slots extending in the volume of the support elements and the slots extending between the support elements have a length from their ends in the pedestal region of the antenna up to the upper edge of the antenna that differs by a maximum of 0.15 and preferably by a maximum of 0.1 is here also the wavelength of the center frequency of the lowest resonant frequency range of the antenna.

The spacing between a lower side of the pedestal and the upper side of the antenna can furthermore amount to between 0.3λ and 0.7λ, preferably between 0.4λ and 0.6λ, with λ being the wavelength of the center frequency of the lowest resonant frequency range of the antenna.

A respective contiguous resonant frequency range of the antenna that has a return loss of better than 6 dB, preferably of better than 10 dB, and further preferably of better than 15 dB, is here generally called the resonant frequency range of the antenna in the sense of the present invention. The center frequency is here the arithmetical mean of the highest and lowest frequency in the resonant frequency range.

The resonant frequency range and thus the center frequency are preferably determined in accordance with the invention with respect to the impedance position in the Smith chart, while assuming the following elements for an ideal impedance matching and/or impedance transformation.

The slot extending in the volume of a dipole element and of the associated support element preferably respectively starts above a pedestal region of the antenna and extends upward from there along the support element and further outwardly from the inner edge of the dipole element. The slot in the dipole element and in the associated support element here in particular extends in a respective plane that extends in parallel with a center axis of the antenna, with the center axis preferably being disposed in the plane defined by the slot.

The slot here preferably passes through the dipole element in the vertical direction. The dipole element is hereby divided into two sections.

In a possible embodiment, the slot can be closed toward the inner edge and/or toward the outer edge of the dipole element. The slot is, however, preferably open toward the inner edge and/or outer edge of the dipole element.

The slot is further preferably open at least toward the outer side of the associated support element. In a possible embodiment, the slot here passes through the support element at least over a part of its extent in the radial direction. The slot here preferably passes through the support element at least in a part region of its extent into said support element adjacent to the dipole element in the radial direction. At least an upper region of the support element is hereby divided into two sections.

In a possible embodiment of the present invention, the slot extending in the volume of a dipole element and of the associated support element can have a substantially constant width over its extent. The width of the slot can here in particular fluctuate by a maximum of 80% with respect to the maximum width in a region that makes up at least 80% of its length. The width in this region preferably fluctuates by a maximum of 50% with respect to the maximum width, further preferably by a maximum of 20% with respect to the maximum width. The width of the slot can further preferably fluctuate by a maximum of 80% with respect to the maximum width in a region that makes up at least 95% of its length. The width in this region preferably fluctuates by a maximum of 50% with respect to the maximum width, further preferably by a maximum of 20% with respect to the maximum width.

In accordance with a preferred embodiment of the present invention, the dipole elements form a dipole square whose diagonals are defined by the polarization planes of the dipoles. The slots in the volume of the dipole elements preferably each extend along the diagonals of the dipole square.

The respective dipole elements here in particular take up a respective quadrant of the dipole square and are separated from one another by slots. The dipole elements themselves are then separated into two sections along the diagonals by the slots extending in their volumes. The sections of the dipole elements are here preferably symmetrical with respect to the diagonals.

In a preferred embodiment of the present invention, the dipole square has a side length between 0.3λ and 0.7λ, with λ being the wavelength of the center frequency of the lowest resonant frequency range of the antenna. The side length here preferably amounts to between 0.4λ and 0.6λ.

The slots in the volume of the dipole elements and of the support elements can extend such that the sections of the dipole elements and/or of the support element separated by the slots are arranged radially about a center axis of the antenna. The sections are here in particular arranged radially next to one another.

The slots in the volume of the dipole elements and/or the slots in the volume of the support elements further preferably each extend radially with respect to the center axis of the antenna.

The slots of oppositely disposed dipole elements and/or support elements here preferably extend in the same plane. Alternatively or additionally, the slots of adjacent dipole elements and/or support elements can extend in planes standing orthogonally on one another.

The slots in the volume of the dipole elements and/or in the volume of the support elements preferably each extend along the polarization planes of the antenna.

A dual polarized antenna in accordance with the present invention preferably has a feed that extends at least partially in the slots arranged in the volume of the support elements.

The feed of the antenna can, in accordance with the invention, comprise a conductor that extends in a slot arranged at least partially in the volume of a support element. The feed of the antenna here preferably takes place on the feed side in the base region of the slot. Unlike with antennas from the prior art in which the feed respectively only took place at the upper end of the support elements or at the inner end of the dipole elements, the slot in the support element is hereby also fed and contributes to the radiation behavior of the antenna.

The feed here preferably has two separate conductors for the feed of the two polarizations of the radiator. The two conductors here preferably extend in a crossed manner with respect to one another. Polarizations of the radiator preferably standing orthogonally on one another can be fed separately by the two conductors.

The conductors here, on the one hand, preferably respectively feed the dipole in whose volume they are arranged. On the other hand, the conductors preferably respectively feed the slot radiators that are formed by the slots in the volume of the dipole elements extending diagonally hereto. The slot radiator formed by a slot in the volume of a dipole element is therefore not fed by the conductor that extends in the slot of the associated support element, but rather by a conductor that extends in a slot of a support element of an adjacent dipole element.

The conductor of the feed preferably enters into the slot in a base region thereof at the feed side and extends upward from the base region in the slot.

Alternatively or additionally, the conductor can extend from a first slot in the volume of a first support element to an oppositely disposed second support element and preferably to the slot arranged therein. The conductor can here extend from the first half of a dipole beyond the center axis of the antenna to the oppositely disposed second half of the dipole to feed the dipole formed by the two dipole halves.

The conductor can preferably extend upward in a first slot and then inwardly over an angled portion from where the conductor extends into the second slot. The conductor here preferably extends downward over a further angled portion in the second slot.

The conductor here preferably extends in the second slot either downward only over a relatively short distance and then ends. The conductor can here preferably extend downward in the second slot over a length of less than $0.2\lambda$ and preferably less than $0.1\lambda$, with $\lambda$ being the wavelength of the center frequency of the lowest resonant frequency range of the radiator. The conductor can alternatively also extend downward substantially to the base region of the second slot and can further preferably dip into a cut-out in the base region.

The sections of the intersecting conductors for feeding the two polarizations in the region in which they cross are preferably shaped such that a certain spacing is observed between the two conductors.

The conductor is furthermore substantially guided upward within the first slot up to a plane of the dipole elements before it is guided over an angled portion to the oppositely disposed slot. The conductor here can in particular be guided upward in the first slot in each case up to a position that is a maximum of $0.2\lambda$, and preferably a maximum of $0.1\lambda$, remote from the upper side of the antenna formed by the dipole elements, with $\lambda$ being the wavelength of the center frequency of the lowest resonant frequency range of the antenna.

In a possible embodiment, the conductor can be held in the slot by a dielectric holder.

In accordance with the invention, a variety of possibilities are conceivable by which an adaptation of the properties of the antenna to the antenna environment and in particular an adaptation of the impedance of the antenna can take place. The side walls of the slots in which the conductors extend can have cut-outs or elevated portions, for example. Alternatively or additionally, the conductor can have different diameters over its extent. One or more dielectric elements can furthermore be arranged in the slot in which the conductor extends. Further alternatively or additionally, a matching circuit can be provided in a feed line to the antenna, for example sections having different widths on the use of a micro strip line.

In a preferred embodiment of the present invention, the feed takes place via the inner conductor of a coaxial cable and/or of a coaxial feed element that extends within a slot in the volume of a support element. The inner conductor is here preferably guided upward from a base section of the slot. The inner conductor here preferably extends such as has already been presented in more detail above with respect to the conductor. The inner conductor can here have a substantially circular cross-section.

In accordance with a preferred embodiment of the present invention, the pedestal of the antenna has a cut-out for insertion of the coaxial cable or of the coaxial feed element in the base region of the slot. At least the inner conductor can here in particular be inserted into this cut-out with a dielectric sleeve surrounding the inner conductor.

In accordance with a first embodiment of the present invention, the cut-out can be a groove that is open toward the side and into which the coaxial cable and/or the coaxial feed element is/are laterally insertable. The groove can in particular be shaped here such that the coaxial cable and/or the coaxial feed element can be laterally clipped in, i.e. is/are held in the groove by an undercut. The coaxial cable and/or the coaxial feed element in this case preferably have an outer conductor in the region of the groove, with the upper end of said outer conductor electrically defining the base region of the slot.

In an alternative embodiment of the present invention, the cut-out can comprise an axial bore into which the coaxial cable and/or a coaxial feed element is/are axially insertable. In this case, the coaxial cable and/or the coaxial feed element can have an outer conductor in the region of the bore. The outer conductor can, however, also be formed by the axial bore itself so that the coaxial cable and/or the coaxial feed element does/do not have to have an outer conductor in the region of the bore.

The inner conductor is preferably surrounded, in particular concentrically surrounded, by an insulation in the cut-out of the pedestal and in particular in the groove or axial bore.

In a first variant of the present invention, an outer conductor of the coaxial cable and/or of the coaxial feed element can here be galvanically or capacitively coupled to the pedestal in the cut-out. With the galvanic coupling, an insulation of the coaxial cable is removed or with a coaxial feed element, no outer insulation is provided in this region so that the outer conductor comes into contact with the cut-out. With the capacitive coupling, the coupling in contrast takes place via the insulation of the outer conductor within the cut-out.

Alternatively, the pedestal can also be coupled to an outer conductor or to ground outside the cut-out. The coupling can, for example, take place at the lower side of the pedestal here.

In accordance with a possible embodiment of the present invention, the feed of the antenna can take place via a coaxial cable whose one end does not have any shielding, with the remaining inner conductor extending at least partially in a slot in the volume of a support element. The inner conductor can here be stripped of insulation in this region in a possible embodiment. The inner conductor is preferably pre-curved in this region so that a simple installation of the feed of the antenna becomes possible.

The coaxial cable can here in particular be laterally insertable, in particular clippable, into a groove of the pedestal of the antenna open to one side. The cable here has at least one insulation in this region via which the inner conductor is guided in the groove. The outer conductor or the shielding is also preferably provided in this region and is preferably galvanically or capacitively coupled to the groove.

Alternatively, the feed of the antenna can take place via a coaxial feed element whose one end does not have any shielding, with the inner conductor remaining in this region extending at least partially in a slot in the volume of a support element and whose other end comprises a plug-in connector for connecting a coaxial cable. The inner conductor is preferably pre-curved here. The coaxial feed element is further preferably laterally insertable, and preferably clippable, into a groove of the pedestal of the antenna open toward one side. The coaxial feed element here preferably has at least one insulation in the region in which it is arranged in the groove. It further preferably also has an outer conductor there that is preferably galvanically or capacitively coupled to the groove.

The two last-named embodiments of the present invention have the advantage that at least the inner conductor no longer has to be soldered on the connection of the antenna. If a direct coupling of the outer conductor in the groove takes place, it also no longer has to be soldered. In a possible embodiment, however, at least the outer conductor can be soldered to the antenna, preferably in the region of the pedestal.

In a further embodiment of the present invention, the feed of the antenna can take place via a coaxial feed element whose one end has not insulation, with the inner conductor remaining there extending at least partially in a slot in the volume of a support element and whose other end is soldered to a circuit board on which the antenna is arranged. The inner conductor can here preferably be pre-curved. The coaxial feed element can furthermore preferably be insertable into an axial bore of the pedestal. The coaxial feed element preferably only has the inner conductor and an insulation surrounding the inner conductor in at least the region of the axial bore, but no outer conductor. The pedestal of the antenna is here preferably separately coupled to a ground of the circuit board. The coupling here in particular takes place at the lower side of the pedestal. The coupling can here, for example, take place capacitively with a ground surface arranged on the circuit board. Alternatively, the coupling can also take place galvanically, for example by one or more soldering pins that are soldered to the ground of the circuit board. The solder pin or pins can also serve as a mechanical security against a rotation of the dipole during installation. The solder pin or pins here preferably passes/pass through a bore in the circuit board. The solder pins can here also serve electrical aspects such as the port insulation and the intermodulation in addition to mechanical aspects such as stability and security against rotation.

The dual polarized antenna in accordance with the invention or the antenna body having the support arms and the dipole elements can be produced in any desired design.

The dipole elements in a first embodiment can in particular form separate components that are connected to the support elements. The support elements can also form separate elements among one another that are connected to one another and/or to a pedestal. The sections of the dipole elements and/or of the support elements formed by the slots can in particular here also be formed by separate elements.

The antenna body is in contrast configured in one piece in a preferred embodiment. The pedestal, the support elements, and the dipole elements of the antenna body are here in particular configured in one piece.

The manufacture of the antenna body of an antenna in accordance with the invention can take place, for example, by angling metal sheet sections.

The antenna body is, however, produced from plastic in a preferred embodiment of the present invention. The antenna body here can either comprise a conductive plastic and/or be coated with a conductive layer. The antenna body is particularly preferably manufactured by an injection molding process. The complex geometry of the antenna body in accordance with the invention can hereby be established without problem.

In addition to the dual polarized antenna as such in accordance with the invention, the present invention furthermore comprises an antenna arrangement having at least one dual polarized antenna in accordance with the invention, and preferably a plurality of dual polarized antennas in accordance with the invention such as was/were described in more detail above.

The antenna arrangement can here comprise a reflector on which the antenna is arranged with its pedestal. The reflector here preferably has a base plate that extends in a plane that extends perpendicular to the center axis of the antenna. The plane of the base plate of the reflector here in particular extends in parallel with a plane in which the dipole elements extend.

In accordance with the invention, the antenna arrangement can here have a base plate and/or a reflector frame, that is arranged around the antenna, and/or reflector walls. The reflector frame and/or the reflector walls can have substantially any desired shape and can have substantially any desired spacing from the antenna.

In a preferred embodiment of the present invention, the spacing between the base plate of the reflector and the plane of the dipole elements, in particular the spacing between the upper side of the base plate of the reflector and the upper side of the antenna, can amount to between 0.3λ and 0.7λ, preferably between 0.4λ and 0.6λ, with λ being the wavelength of the center frequency of the bottommost frequency range of the antenna.

In a possible embodiment of the present invention, the antenna arrangement can comprise a circuit board on which one antenna in accordance with the invention, and/or preferably a plurality of antennas in accordance with the invention, is/are arranged. If coaxial feed elements are used here such as have been described above, they can be respectively soldered to microstrip lines on the circuit board. Matching circuits can be provided on the circuit board.

The present invention will now be described in more detail with reference to an embodiment and to drawings.

DETAILED DESCRIPTION

Figure 1:
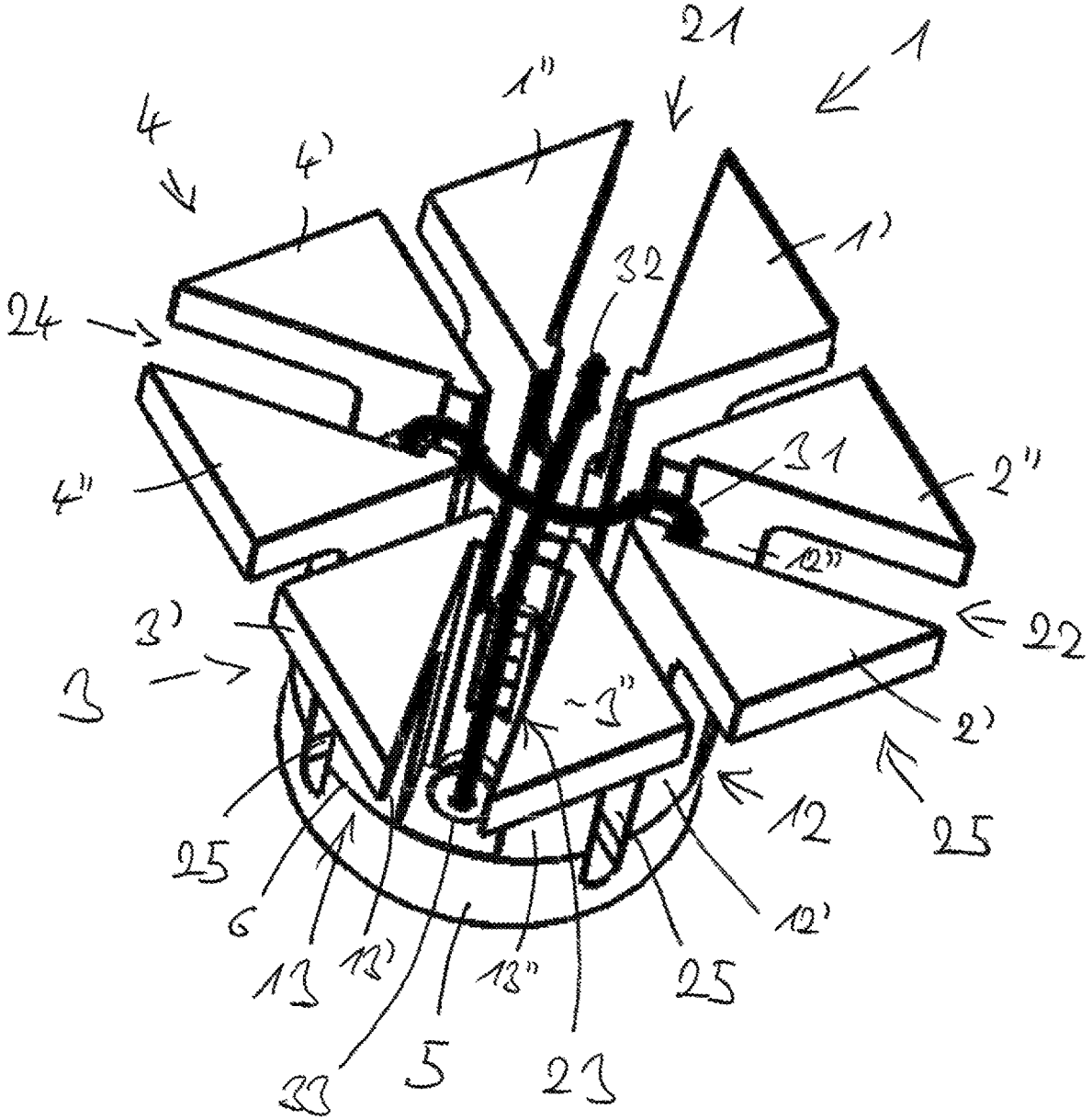
FIG. 1 shows a first embodiment of a dual polarized antenna in accordance with the invention in a perspective representation.
Figure 2:
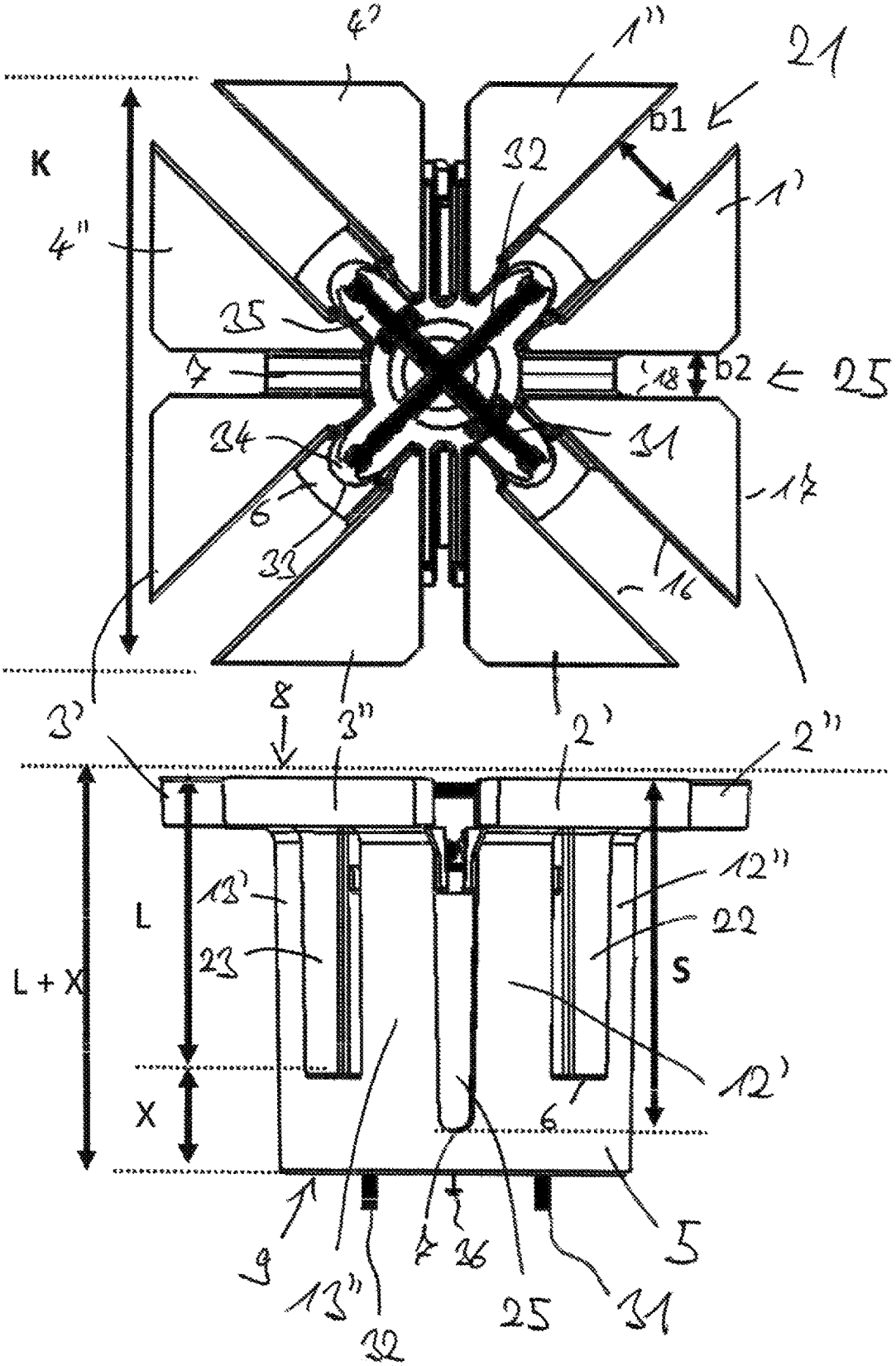
FIG. 2 shows the embodiment shown in FIG. 2 in a plan view and in a side view.
Figure 3:
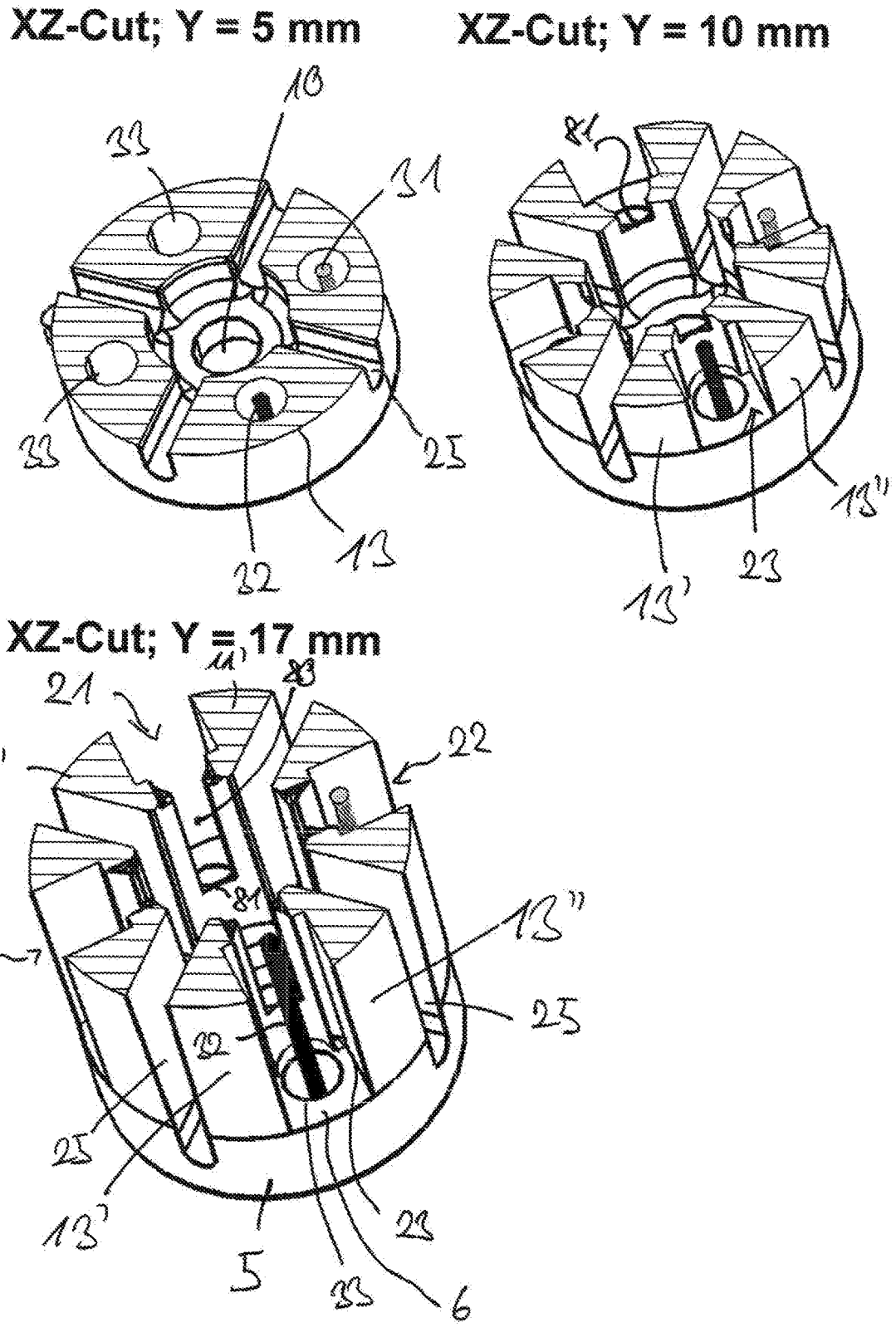
FIG. 3 shows three sectional representations through the support elements of the embodiment shown in FIG. 1 along a plane that stands perpendicular on the main axis of the antenna at heights of 5 mm, 10 mm and 17 mm.

In FIGS. 1 to 3, a first embodiment of an antenna in accordance with the invention is shown. The general design of the antenna shown in FIGS. 1 to 3 is, however, also maintained in the remaining embodiments.

The antenna has for dipole elements 1 to 4 that are each arranged at an associated support element 11 to 14. All the support elements are connected to a pedestal 5 of the antenna in a lower region of the antenna. The support elements 11 to 14 extend separately upward from this common pedestal. The dipole elements 1 to 4 that extend in a plane that stands perpendicular on the center axis of the antenna are arranged at the upper end of the support elements. The individual support elements and dipole elements are here separated from one another by slots 25. The slots 25 stand perpendicular on one another and thus divide the antenna into four quadrants.

In accordance with the invention, a slot 21 to 24 is now provided in the volume of each dipole element and is extended into the associated support element 11 to 14 from the respective dipole element.

The slots 21 to 24 pass through the dipole elements 1 to 4 in a vertical direction and divide each of them into two sections. The dipole element 1 is thus separated via the slot 21 into two sections $\mathbf{1}'^{I}$ and $\mathbf{1}''^{II}$. The same applies to the remaining dipole elements 2 to 4 that are accordingly separated into sections $\mathbf{2}'^{I}$ to $\mathbf{4}'^{I}$ and $\mathbf{2}''^{II}$ to $\mathbf{4}''^{II}$.

The region of the slots extended into the support elements is open toward the outer side of the support elements. In the embodiment, the slot here also at least passes radially through the support elements in a region 80 adjacent to the dipole elements and therefore separates said support elements into two sections. The support element 11 is thus divided by the slot 21 into two sections $\mathbf{11}'^{I}$ and 11". The same applies to the remaining dipole elements 12 to 14 that are accordingly separated into sections $\mathbf{12}'^{I}$ to $\mathbf{14}'^{I}$ and $\mathbf{12}''^{II}$ to $\mathbf{14}''^{II}$.

The region 80 in which the slots pass radially through the support elements does not, however, extend completely up to the base region 6 in the embodiment, but rather ends in a gradation 81 above the base region 6 of the slots. The length of the slot is measured from the base region 6 and is, as shown in more detail in the following, of decisive importance for the radiation properties of the antenna. The length of the region 80 can be used for the fine coordination and/or bandwidth expansion.

Figure 14:
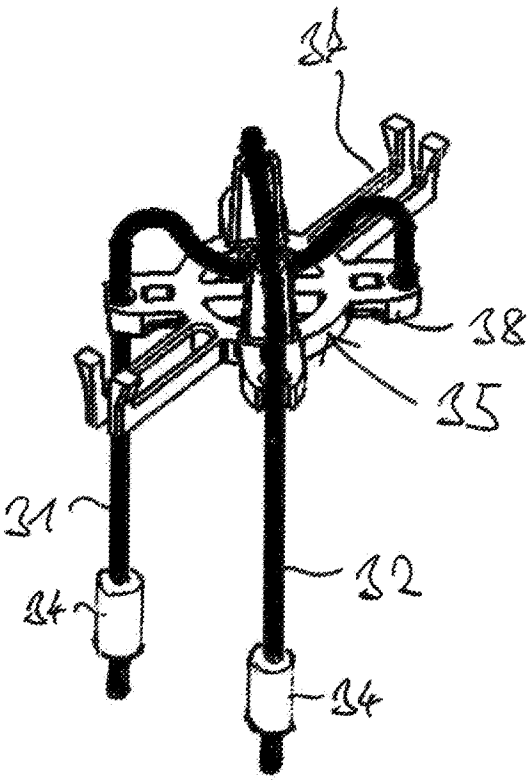
FIG. 14 shows at the left, the embodiment of an antenna in accordance with the invention already known from FIG. 1 to FIG. 3, with the feed and a holder for the conductor of the feed being shown separately at the right.
Figure 14:
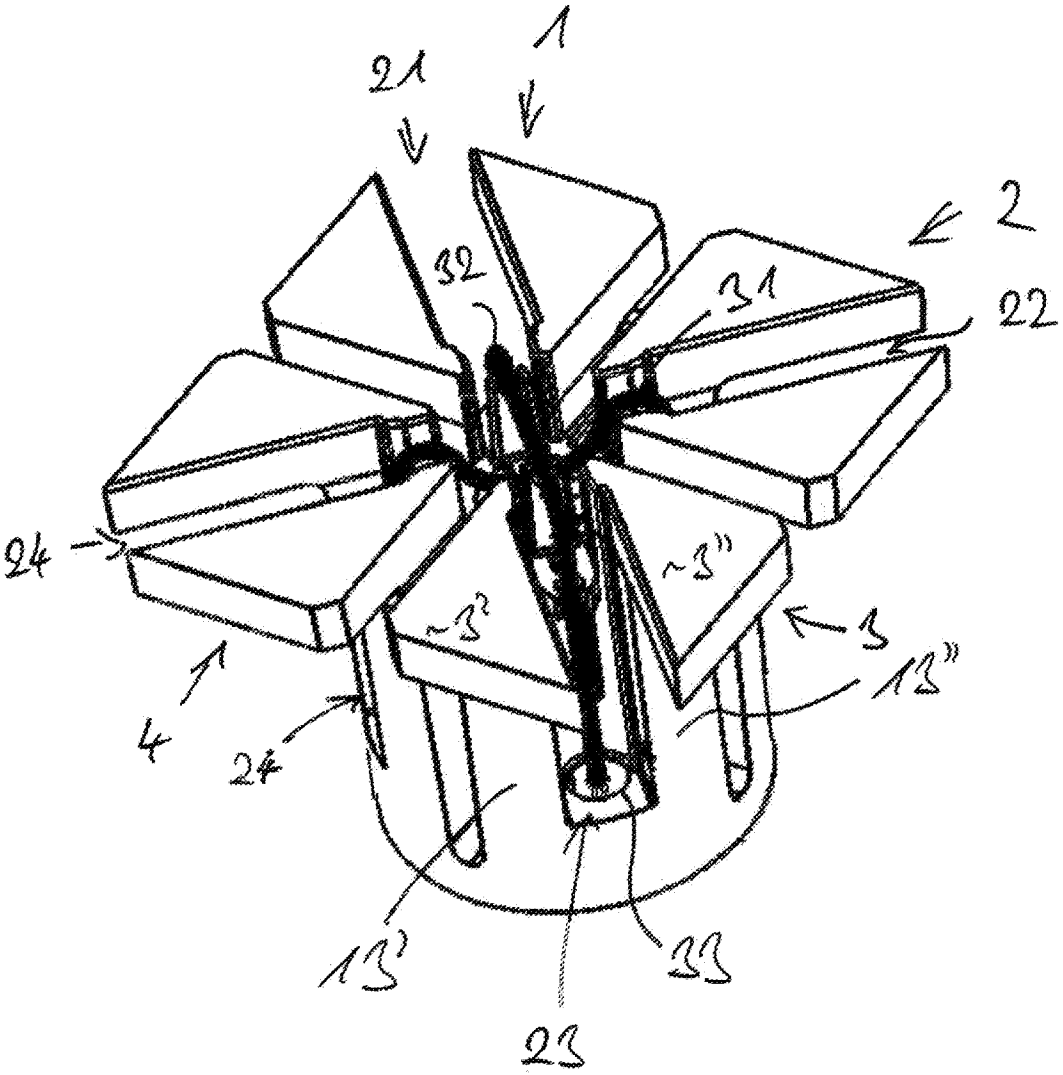

As can furthermore in particular be recognized in FIGS. 2 and 14, the slots become somewhat narrower toward the inner side of the support elements in the region of the support elements before they pass radially through the support elements and therefore enclose the inner conductors a little more strongly on the inner side of the support elements. In the embodiment, the region of the slot in which it changes from the larger width to the smaller width is rounded in circular segment form toward the inner conductor. However, other embodiments are also conceivable here. Independently of the shape of the side walls of the slots in the region of the support elements, their width b1 is measured on the radius on which the conductor also extends.

The slots 21 to 24 here each extend diagonally in the support elements or dipole elements and thus along a plane that extends through the center axis of the antenna.

Since the dipole elements and the associated support elements are divided into two sections by the slots, the antenna comprises eight dipole element sections that are each separated from one another and that are each arranged via a support element section at the pedestal 5. The dipole element sections and support element sections of a dipole or of a support element are here separated from one another by the slots 21 to 24; the dipole sections or support sections of adjacent dipoles or support elements by the slots 25.

The feed of the antenna in accordance with the invention takes place via conductors 31 and 32 that extend in the slots 21 to 24 in the volume of the support elements 11 to 24.

Viewed electrically, the dipole elements 1 and 3 here form a first dipole and the dipole elements 2 and 4 form a second dipole. The first dipole is here fed via the conductor 32; the second dipole via the conductor 31. The polarization planes of the two dipoles here extend diagonally to the dipole square formed by the dipole elements. The slots 21 and 23 in the first dipole and the slots 22 and 24 in the second dipole thus respectively extend along the polarization plane of the associated dipoles.

The slots 21 to 24 in the dipoles and support elements here act as slot radiators so that an increase of the bandwidth results in an optimum utilization of the available volume.

Figure 4:
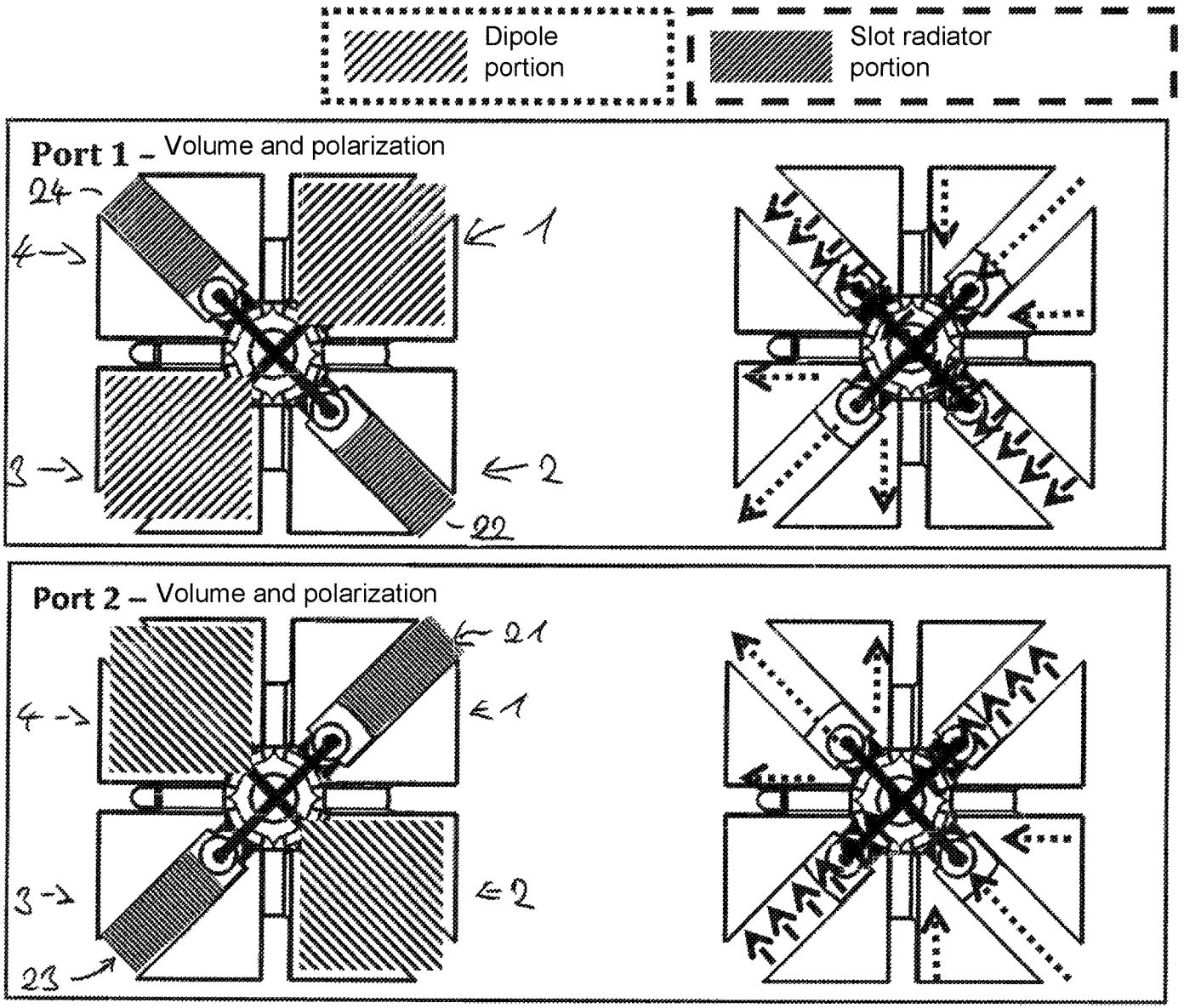
FIG. 4 shows a schematic representation of the proportion of the dipole radiators and of the slot radiators for the feed via the first and second ports of the antenna respectively.

As shown in more detail in FIG. 4, the slot radiators formed by the slots 22 and 24 in the dipole elements 2 and 4 have the same polarization as the first dipole formed by the dipole elements 1 and 3. Conversely, the slot radiators formed by the slots 21 and 23 in the dipole elements 1 and 3 have the same polarization as the second dipole formed by the dipole elements 2 and 4. The slots in the volume of the second dipole thus have the same polarization as the first dipole and vice versa. The slot radiators formed by the slots in the second dipole are furthermore fed by the feed of the first dipole and vice versa.

The antenna in accordance with the invention thus corresponds to a combination of dipoles and slot radiators, with the slot radiators belonging to a dipole respectively being arranged in the volume of the other dipole. A particularly compact arrangement hereby results.

Figure 5:
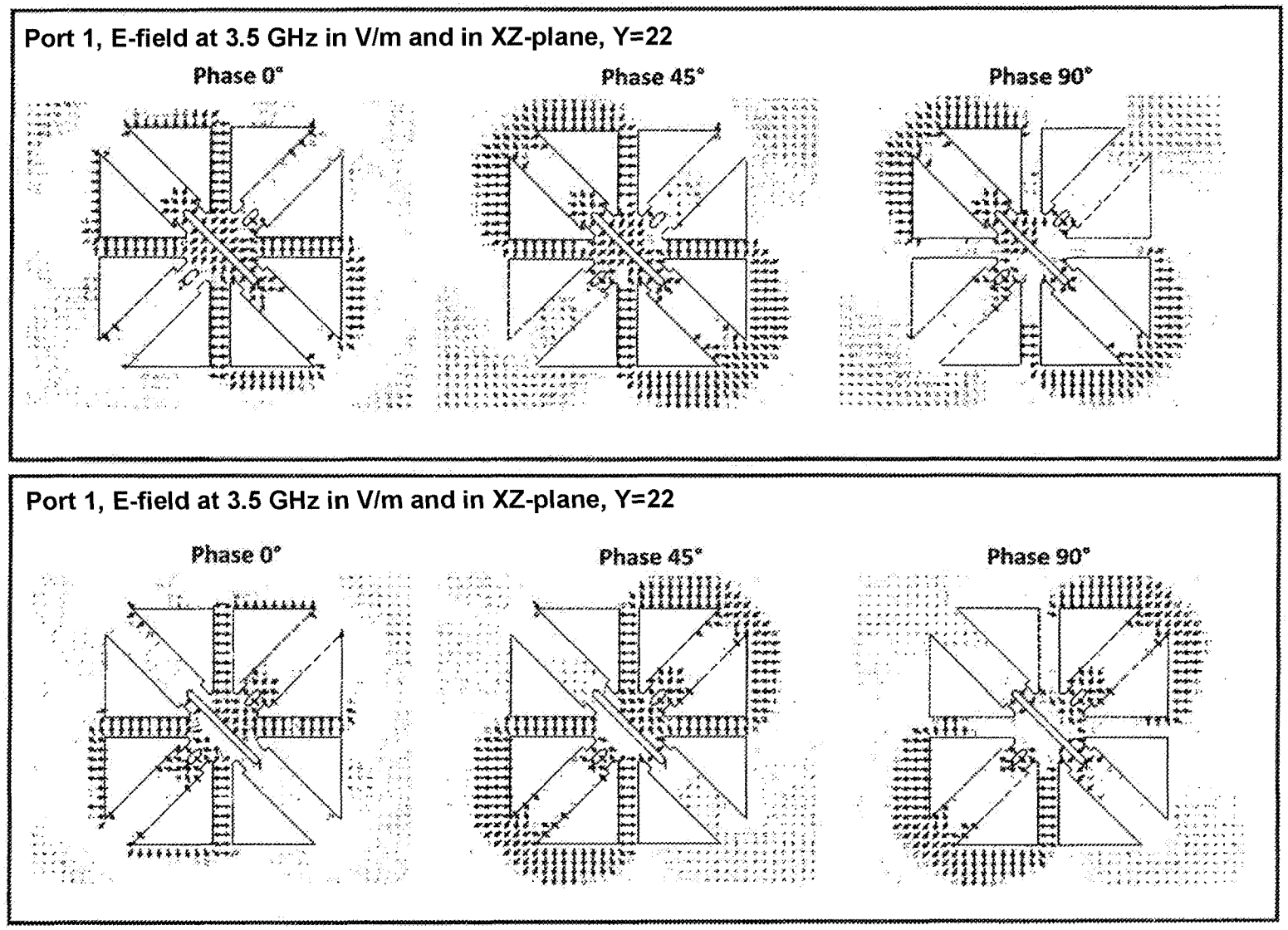
FIG. 5 shows a diagram of the E-field distribution at 3.5 GHz with different phases for a feed of the antenna via the first port or the second port.
Figure 6:
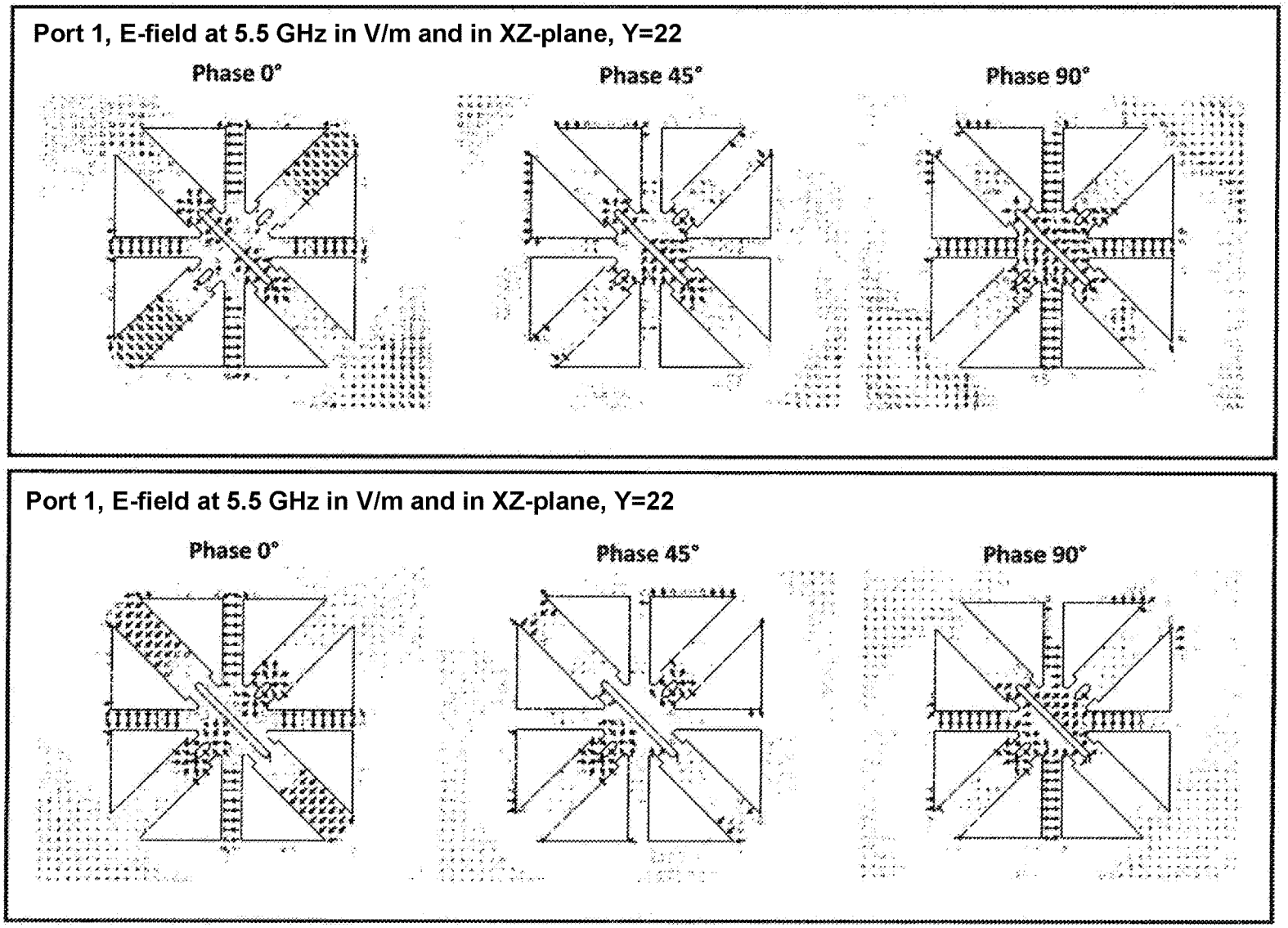
FIG. 6 shows a diagram of the E-field distribution at 5.5 GHz with different phases for a feed of the antenna via the first port or the second port.

The E-field distributions of an antenna in accordance with the invention on a control of port 1 or port 2, i.e. on a feed via the conductor 31 or the conductor 32, are shown in FIGS. 5 and 6 for different phases of the signal. FIG. 5 here shows the E-field at 3.5 GHz; FIG. 6 the E-field at 5.5 GHz. What is shown in each case is the field in a plane in parallel with the plane of extent of the dipoles at the level of the dipoles. As can be clearly recognized from a comparison of FIGS. 5 and 6, the proportion of the dipoles and of the slot radiators varies in dependence on the frequency. On the control at 3.5 GHz shown in FIG. 5, the proportion of the dipole radiators in the total power dominates; on the control at 5.5 GHz shown in FIG. 6, the proportion of the slot radiators rather dominates.

Figure 7:
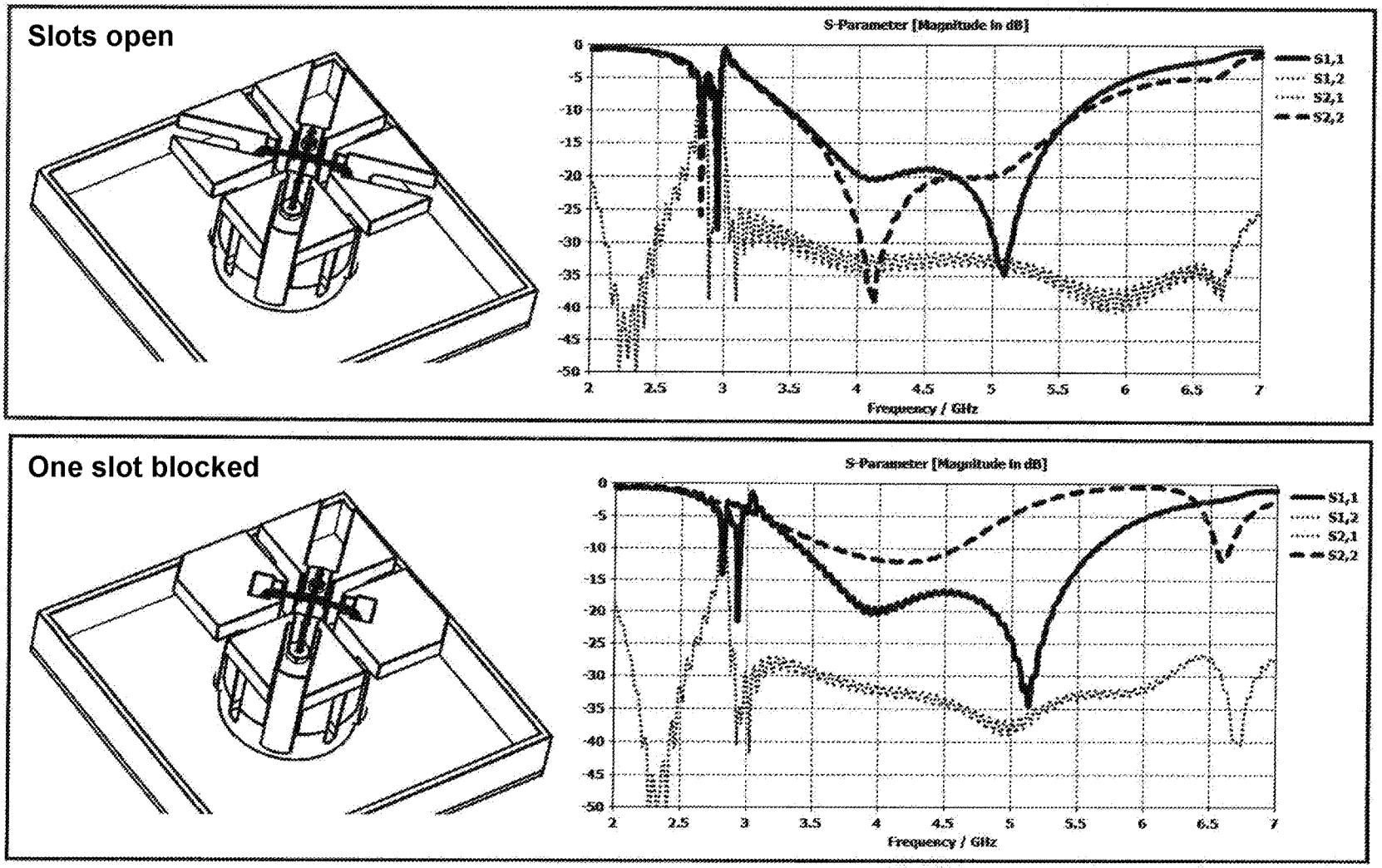
FIG. 7 shows two diagrams of the S parameter in dependence on the frequency with the S parameter for an antenna in accordance with the invention having slots arranged in the dipole elements being shown at the top and the same diagram being shown at the bottom for a comparison example in which the slots in the dipole elements of one of the two dipoles have been blocked.

The considerable significance of the slots in the volume of the dipole elements for the radiation characteristics of the antenna in accordance with the invention becomes clear by the comparison shown in FIG. 7 with a modified antenna in which the slots in one of the dipoles have been blocked.

The embodiment in accordance with the invention which is also shown in FIGS. 1 to 3 is shown at the top in FIG. 7 together with a diagram of the S parameter in dependence on the frequency. The continuous line S1,1 shows the S parameter for port 1; the dashed line S2,2 shows the S parameter for port 2. The dotted lines S1,2 and S2,1 shows the crosstalk of the two ports between one another. As can be clearly recognized at the top in the diagram in FIG. 7, the antenna has a wide frequency range for both ports from approximately 3.5 to 5.6 GHz in which the S parameter amounts to less than −10 dB. The total with of the resonant frequency range for the two ports is substantially identical here; the best values are displaced with respect to one another, however. This is due to the slightly different guidance of the conductors 31 and 32 of the respective ports.

FIG. 7 shows at the bottom the same S diagram for an antenna in which the slot in the dipole that is fed via port 1 has been blocked. As can be seen from the solid line S1,1, the blockage of the slot has no greater effect for the radiation characteristics of this dipole. In contrast, the radiation diagram for the dipole that extends diagonally to the blocked slot and that is fed via port 2 is extremely degraded by the blockage of the slots in the dipole that is fed via port 1, as can be seen from the dashed line S2,2 at the bottom in FIG. 7. This confirms that the slots in the volume of the one dipole are excited by the feed of the respective other dipole. In addition, the diagram shows that the slots make a substantial contribution to the radiation behavior of the antenna in accordance with the invention.

The general dimensions of an antenna in accordance with the invention are here first shown with reference to FIG. 2.

The antenna has a square base shape in the plan view that is defined by the polarization planes extending along the diagonal and by the extent of the dipoles along these polarization planes. The four dipoles 1 to 4 each take up a quadrant of the base surface here. The base surface has a side length K. It preferably applies here $$K=0.5\lambda\pm0.1\lambda,$$

where λ is the wavelength of the center frequency of the resonant frequency range of the antenna.

The total height of the antenna from a lower side 9 of the pedestal up to the upper side 8 of the dipole elements has a length L+X. It preferably applies here $$L+X=0.25\lambda\pm0.2\lambda,$$

where λ is the wavelength of the center frequency of the resonant frequency range of the antenna.

The slots 21 to 24 in the support elements extend in the embodiment from their ends in the pedestal region 5, i.e. from their base regions 6, up to the upper side 8 of the antenna over a length L. The height of the pedestal region up to the start of the slots in contrast has a height X. The total height of the antenna from a lower side 9 of the pedestal up to the upper side 8 accordingly has a length L+X.

The effective length of the slots is thus composed of the length of each slot in the region of the dipole element and of the length L of the slot in the region of the associated support element. The influence of the length L of the slot in the support element is illustrated here with reference to FIGS. 8 and 9.

The slots in the dipole elements extended into the support elements preferably have a total length of 0.5λ±0.1λ, with λ being the wavelength of the center frequency of the resonant frequency range of the antenna. This preferred length of the slots is also the reason for the extension of the slots into the support elements since the slots in the dipole element only have a length of approximately 0.25λ and the ideal total length would therefore exceed the length of the slots in the dipole elements.

Figure 8:
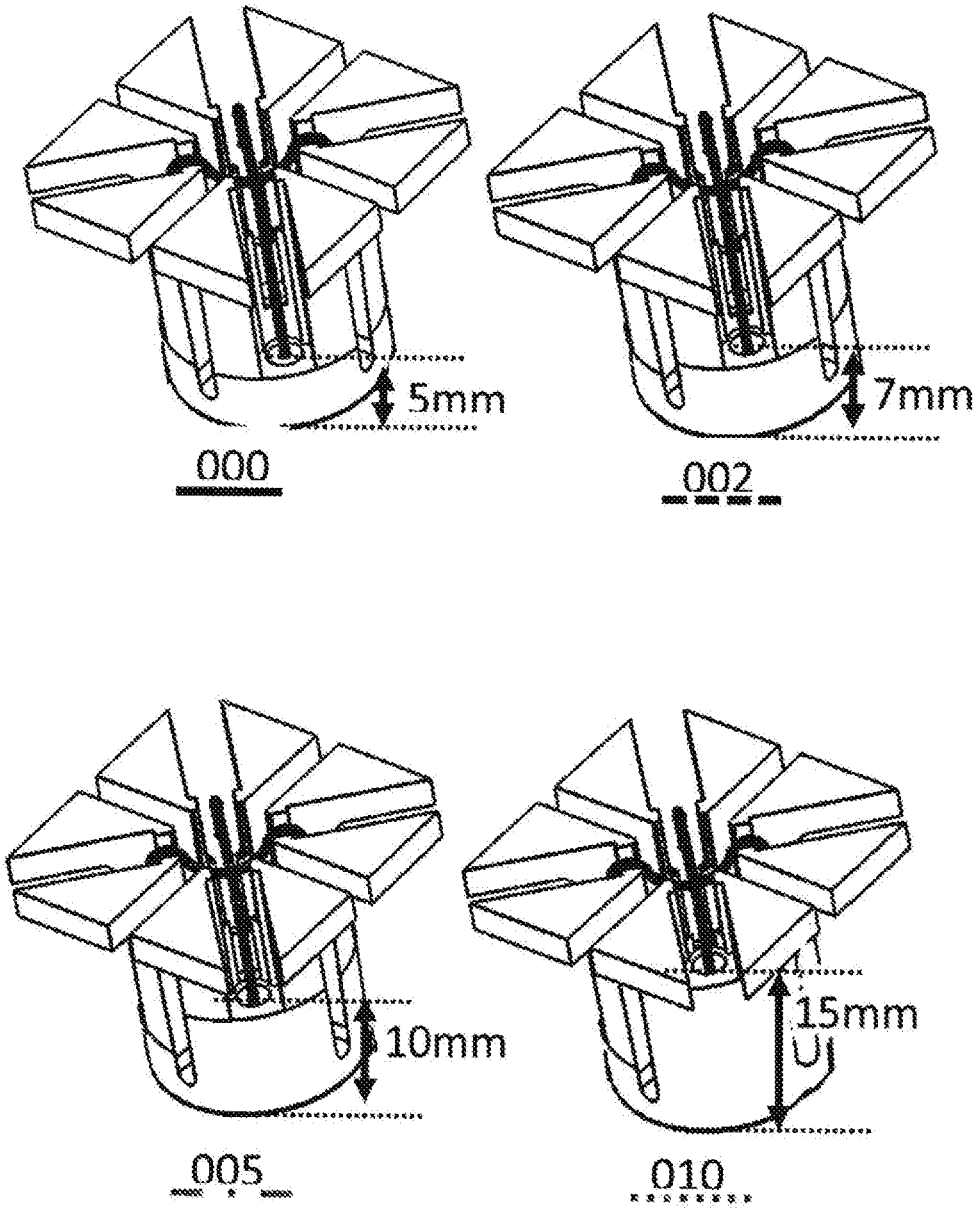
FIG. 8 shows four embodiments of an antenna in accordance with the invention having slots of different lengths in the support elements.

Four embodiments having slots of different lengths are shown in FIG. 8. The embodiments here have a base surface of the dipole square with a side length K=29 mm and have a total height of the antenna L+X of 23 mm. The wavelength λ of the center frequency of the antenna amounts to approximately 64 mm.

The following dimensions thus apply to the four embodiments that are marked as 000, 002, 005, and 010 and that are shown in FIG. 8:

| Embodiment | X [mm] | L [mm] |
|---|---|---|
| 000 | 5 | 18 |
| 002 | 7 | 15 |
| 005 | 10 | 13 |
| 010 | 15 | 8 |

Figure 9:
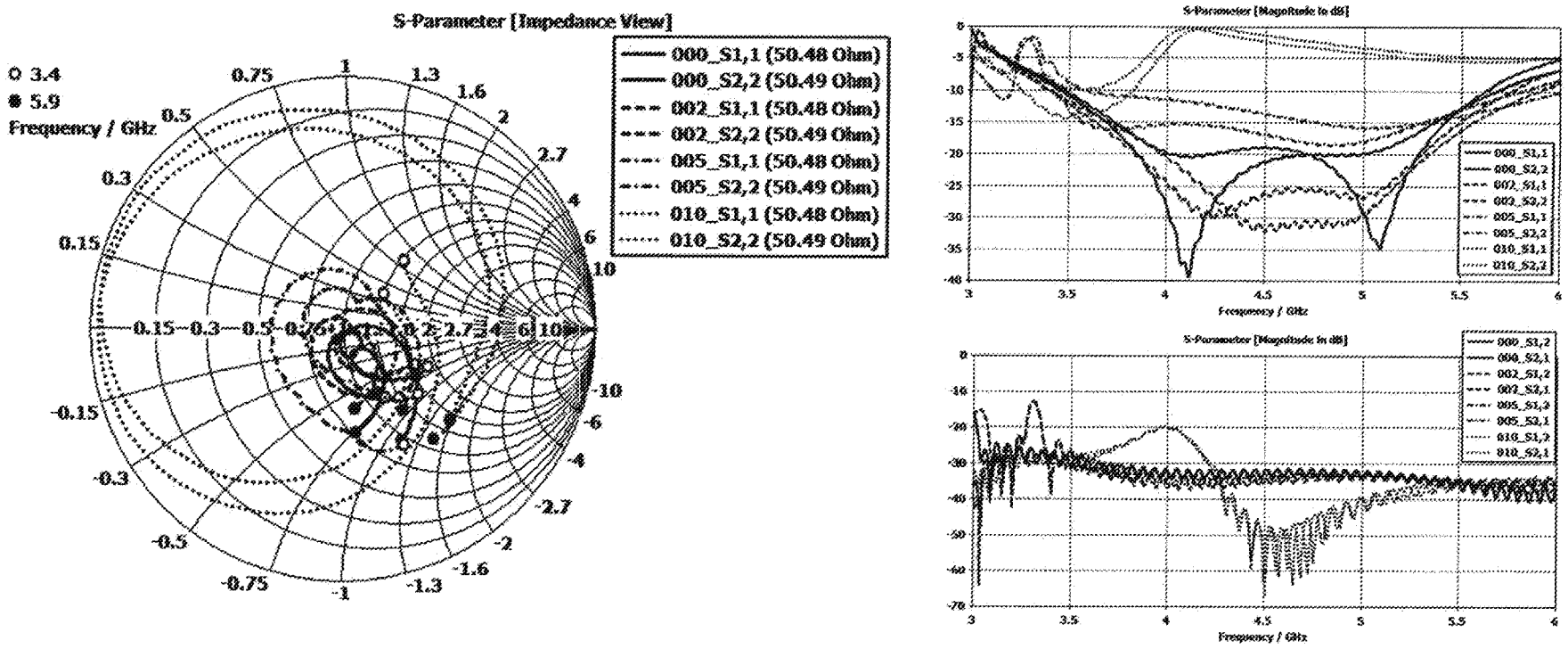
FIG. 9 shows Smith charts and diagrams of the S parameter in dependence on the frequency for the four embodiments shown in FIG. 8.

The corresponding Smith charts and S parameter diagrams for the different ports of these four embodiments are shown in FIG. 9. As can be clearly recognized, a high dependency on the length L of the slot in the support element results. Ideal values result here for a length L that corresponds to a quarter of the wavelength λ of the center frequency and to the adjacent wavelength range. This corresponds to an approximately fifty percent distribution of the total length of the slots over the dipole elements and the support elements.

The length of the slot in the support element therefore preferably amounts to:

$$L=0.25\lambda\pm0.1\lambda,$$

The width b1 of the slots 21 to 24 amounts to 4.6 mm in the embodiment. The width b2 of the slots 25 between the support elements amounts to 2.5 mm. The width b1 and b2 of the slots is less critical. The width of the slots, in particular the maximum width, however, preferably amounts to 0.15λ or less, preferably 0.1λ or less.

The dipole elements in the embodiment shown in FIGS. 1 to 3 have a planar, substantially square basic shape so that the respective dipole sections formed by the slots 21 to 24 substantially have the shape of a triangle. The inner sides 16 of the dipole sections here form the longer side of the triangle and are each disposed opposite one another via the slot extending in the volume of the dipole element. The two shorter limbs 17 and 18 of the triangle are of equal length and have an angle of 90° with respect to one another. The sides 18 of adjacent dipole elements are here each disposed opposite one another via the slots 25; the outer sides 17 face outwardly. In the embodiment, the corners between the shorter limbs 17 and 18 have already been slightly cut off.

As can be seen with reference to FIGS. 10 to 13, the radiation properties, however, do not depend in a decisive manner on the exact shape of the individual dipole elements or of the dipole element sections. In this respect, the embodiment of an antenna in accordance with the invention that was designated by V001 and that was already shown in FIGS. 1 to 3 is shown at the left in FIG. 10. A second embodiment V002 is shown at the right in which the dipole elements have a different shape.

The pedestal and the support elements of embodiment V002 are identical to the first embodiment here; equally the inner sides 16 of the dipole elements and the slots forming these inner sides in the volume of the support elements and of the dipole elements. The dipole element sections, however, no longer have a triangular shape, but rather the shape of a cut-off triangle or of an equilateral trapezoid. The base side of the trapezoid is here formed by the inner sides 16 of the dipole element sections; the limbs by the sections 27, that face toward the outer side of the antenna, and 28, via which the dipoles are respectively disposed opposite adjacent dipoles via the slots 25. The upper side of the trapezoid is formed by a side 29 extending in parallel with the base side 16.

Figure 11:
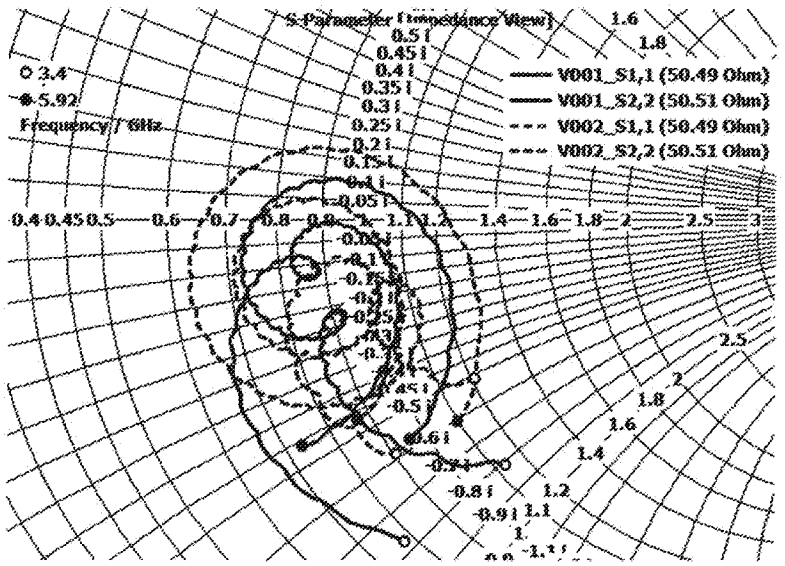
FIG. 11 shows at the left, a diagram of the S parameter in dependence on the frequency and, at the right, a Smith chart for the two embodiments shown in FIG. 10.
Figure 11:
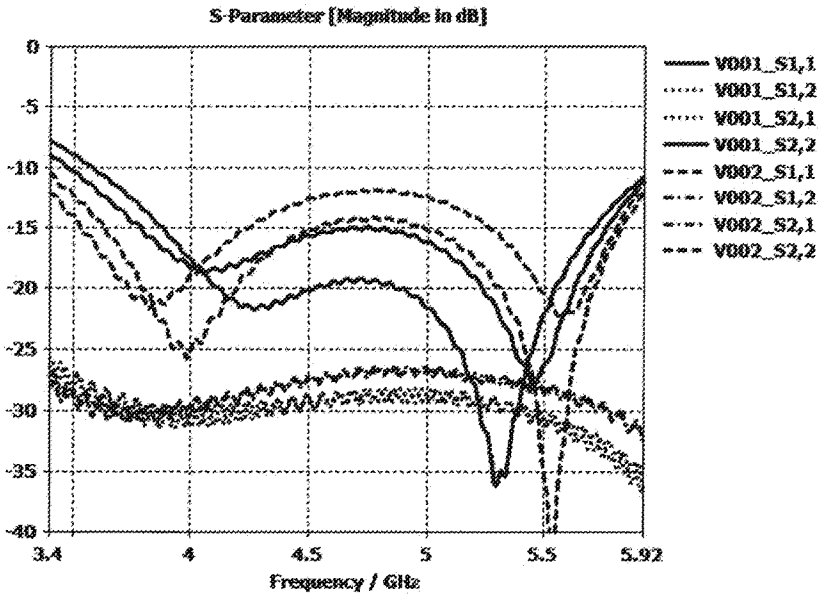
Figure 12:
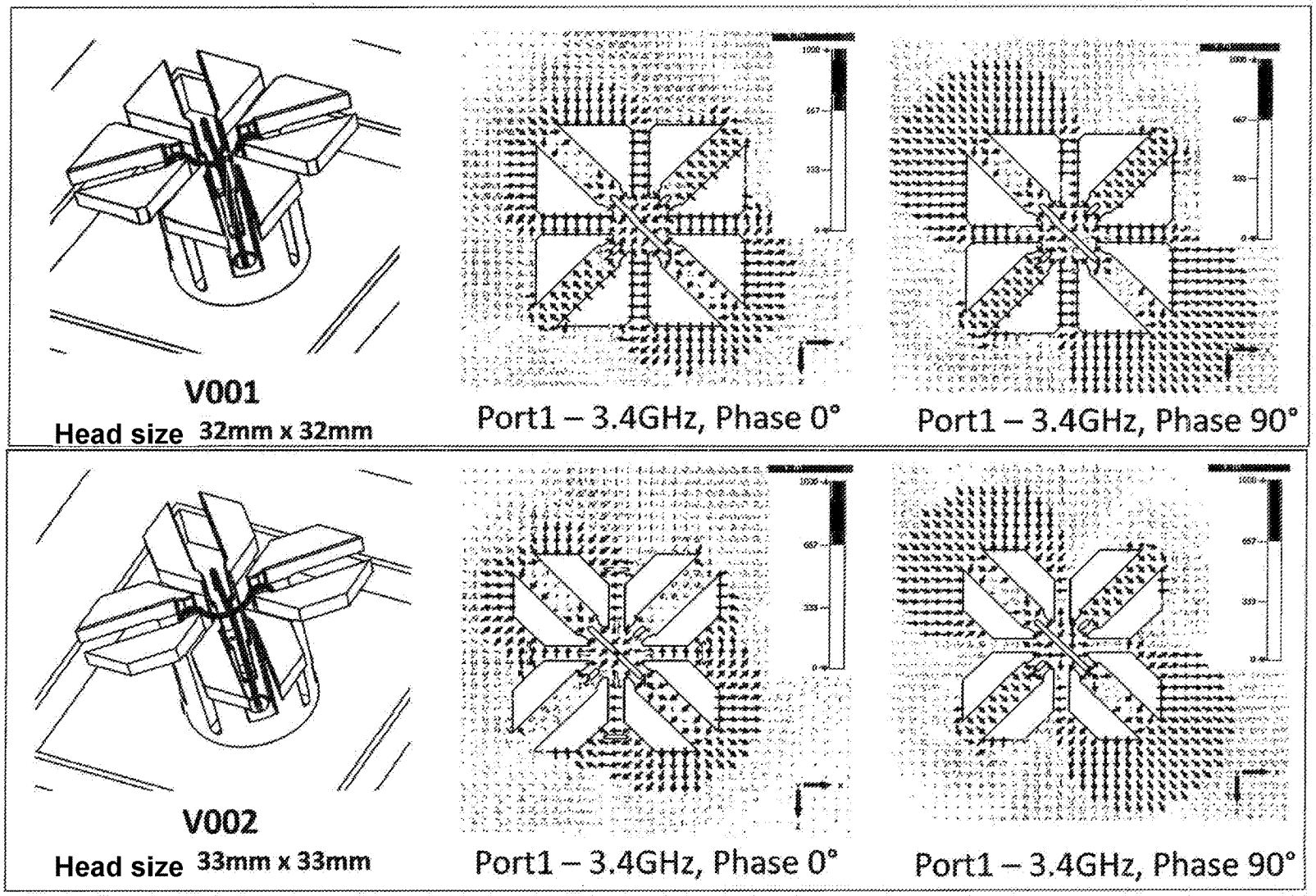
FIG. 12 shows the E-field distribution at 3.4 GHz at different phases for the two embodiments shown in FIG. 10.
Figure 13:
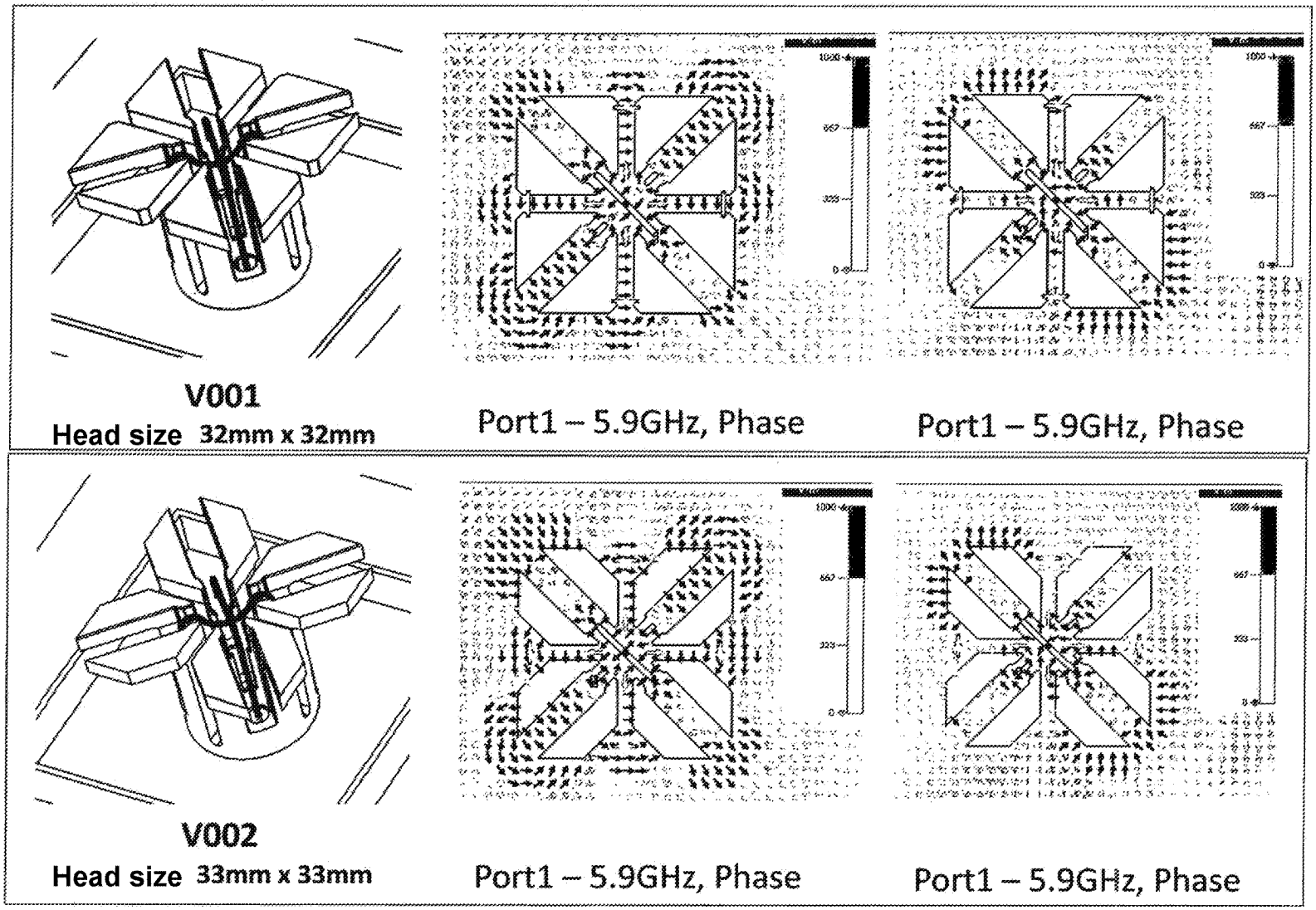
FIG. 13 shows the E-field distribution at 5.9 GHz for different phases for the embodiments shown in FIG. 10.

An S diagram and a Smith chart for the two embodiments is now shown in FIG. 11; in FIGS. 12 and 13, the field distribution at 3.4 GHz and at 5.9 GHz respectively. As can be clearly recognized, there are only relatively small differences between the radiation properties of the two different embodiments of the antennas in accordance with the invention. The shape of the outer sides of the dipole elements is therefore obviously not decisive for the radiation properties of the antenna.

The antennas in accordance with the invention here furthermore have a general shape that should be described again in more detail in the following. Depending on the embodiment, also only individual ones of the geometrical features described in the following can be implemented here.

The pedestal 5 extends upward from a base plane 9 of the antenna, by which the antenna can, for example, be arranged on a circuit board or on a reflector and is extended upward by the support elements 11 to 14. The dipole elements 1 to 4 form a dipole plane 8 of the antenna that extends in parallel with the base plane 9. The pedestal 5 and the support elements 11 to 14 extend between the base plane 9 and the dipole plane 8. The support elements are connected to the pedestal 5 in their lower region. They support the dipole elements 1 to 4 in the upper region.

The individual support elements and dipole elements are separated from one another by slots 25 that divide the antenna into four quadrants. The slots 21 to 25 that each extend in the volume of the dipole elements and of the support elements extend diagonally to the slots 25 between the support elements. The intersection region of the slots 25 forms a center cut-out 10 along the center axis of the antenna. They also pass through the pedestal in the embodiment. Alternatively, however, the pedestal can also be closed in the region of the center axis. The center cut-out is of circular cylinder shape in the embodiment. Other shapes are, however, also conceivable here.

The support elements and the dipole elements are arranged radially about the center cut-out 10. The conductors 31 and 32 of the feed extend through the center cut-out 10 from a first slot of a support element to the oppositely disposed support element and in particular into the slot arranged there. The conductors 31 and 32 of the feed here intersect in the region of the center cut-out.

The support elements extend in the embodiment substantially in parallel with the center axis of the antenna or perpendicular to the base plane 9 and to the dipole plane 8. The dipole elements extend radially outwardly from the support elements.

In the embodiment, the outer sides of the support elements form a cylinder interrupted by the slots. The plate-shaped dipole elements that extend outwardly over the cylinder are arranged at the top on this cylinder. However, other base shapes for the support elements and for the dipole elements are also conceivable here.

The body defined by the support elements and by the slots disposed therebetween as well as by the center cut-out preferably has a cross-sectional surface that makes up a maximum of 70% of the total base surface of the antenna in the region of the dipole elements (including slots and center cut-out), further preferably a maximum of 60%, yet further preferably a maximum of 50%.

Figure 10:
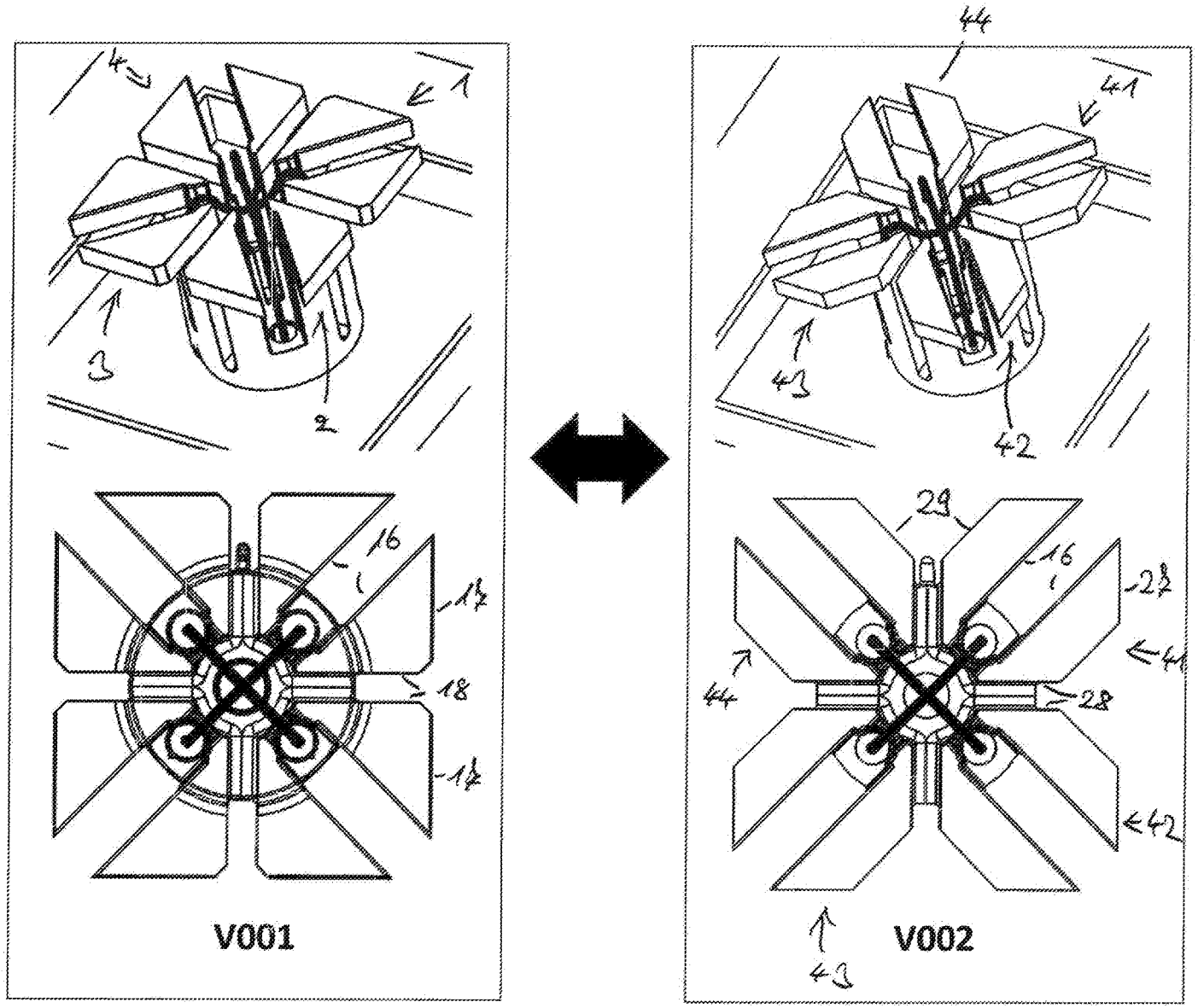
FIG. 10 shows at the left, a perspective view and a plan view of the first embodiment already shown in FIG. 1 to FIG. 3 and, at the right, a perspective view and a plan view of a second embodiment in which the shape of the dipole elements has been changed.

The slots 25 between the individual support elements or dipole elements do not have to have any specific shape since they only serve the electrical separation. The length of these slots in the head, i.e. in the dipole square between the dipole elements, is also not of decisive importance, as, for example, the comparison of the embodiments in FIG. 10 shows. In contrast the length of the slots 25 in the pedestal is significant for the radiation properties of the dipole radiator ($\lambda/4$ symmetry slot and/or balun).

The slots 21 to 24 have a decisive role for the radiation characteristic of the antenna in accordance with the invention so that in particular their length has, as discussed in more detail further above, has to be coordinated to the total dimensions of the antenna or to the wavelength of the center frequency of the antenna. The width b1 of the slots 21 to 24 preferably fluctuates here over 80%, and further preferably over 95%, of its total extent, by less than 50% with respect to the maximum width. The slot here in particular has a comparable width in the region of the dipole elements and in the region of the support elements.

In the embodiment, the support elements 11 to 14 have a certain thickness in the radial direction, just like the dipole elements have a certain thickness perpendicular to their plane of extent. The ratio between the thickness of the support elements in the radial direction and the thickness of the dipole elements in the vertical direction here preferably amounts to between 1:5 and 5:1, preferably between 1:3 and 3:1. The thickness of the support elements in the radial direction is preferably larger than the thickness of the dipole elements in the vertical direction.

In the embodiment in FIGS. 1 to 3, the dipole elements here each have a planar shape. Alternatively, the dipole elements, however, also extend in bar shape along the slots 21 to 24, i.e. are formed in each case by bars extending in parallel with the diagonals.

In the embodiment, the antenna body of the antenna in accordance with the invention is produced from plastic, in particular as an injection molded part. The antenna body is here provided with a conductive coating. In accordance with the invention, however, other construction principles for the antenna are also conceivable. For example, the dipole elements and/or the support elements can also be produced from sheet metal elements and/or metal bars. The casting of the antenna from a metallic material is also conceivable.

In the embodiment, the antenna body formed by the support elements and the dipole elements has a fourfold symmetry with respect to the center axis as a symmetry axis. The antenna body is furthermore symmetrical with respect to the center axis.

As already briefly addressed above, the feed of the antenna takes place via the conductors 31 and 32 extending in the slots of the support elements. The feed used in the first embodiment shown in FIGS. 1 to 3 will now be shown again in more detail with reference to FIG. 14.

The feed for the dipole formed from the dipole elements 1 and 3 takes place via a conductor 32; the feed for the second dipole formed by the dipole elements 2 and 4 via a conductor 31. The conductors 31 and 32 here each substantially have the shape of a reverse L or U. The conductors 31 and 32 each extend, viewed from the feed side, in the slot 23 or 24 respectively upward from its base region in the support element. An inward angling takes place approximately at the height of the dipole elements so that the conductor respectively extends through the center cut-out 10 of the antenna into the slot 21 or 22 of the oppositely disposed support element. A further angling takes place there so that the conductor extends downward in the slot. As can be seen from FIG. 14, the conductor section that extends downward in the oppositely disposed slot is relatively short in the embodiment. Alternatively, however, the conductor could also extend completely downwardly through the complete slot.

The two conductors 31 and 32 here intersect in the region of the center axis in the center cut-out 10 of the antenna. To achieve a sufficient spacing between the conductors, the conductor 31 has a downwardly directed bend so that the conductor 32 can be led beyond this bend.

In the embodiment shown in FIG. 14, the conductors are held in the slots via the dielectric holder 35. The dielectric holder 35 here has clamps 38 which are arranged in the slots 21 to 24 and into which the conductors 31 and 32 can be clipped. The holder 35 furthermore has holding arms 37 via which it is held in the slots 25. The holder 35 thus provides the correct positioning of the conductors 31 and 32 in the slots.

To be able to introduce the conductors into the slots from below at the feed side, the slots have respective cut-outs 33 in their base region 6 through which the conductors 31 and 32 respectively are led. In the embodiment shown in FIG. 14, the cut-out 33 is an axial bore, i.e. a bore extending in parallel with the center axis of the antenna that passes through the pedestal 5 of the antenna. The conductors 31 and 32 here have an insulation 34 in the region in which they are led through the cut-outs 33.

The conductors 31 and 32 in the embodiment are thus inner conductors of a coaxial cable or of a coaxial feed element. The inner conductor in the embodiment here has an unchanging circular cross-section. It would, however, also be conceivable to make use of inner conductors to adapt the antenna that have a cross-section that varies over its extent and/or a cross-section differing from the circular shape.

The conduction modes are led into the gap in the feed shown in FIG. 14 in the region of the axial bore 33 coaxially over the inner conductor 32 and the axial bore 33 acting as an outer conductor. The conduction modes become radiation modes on the entry into the gap so that the feed of the antenna takes place in the base region of the slots.

The slots in which the inner conductors are guided preferably substantially have the same width as the cut-out 33 in the base region of the slot so that too large an impedance jump does not occur. The width b1 of the slots preferably in particular amounts to between half and twice the diameter of the cut-out 23.

In the embodiment shown in FIG. 14, coaxial feed elements are used that only consist of the inner conductor 31 or 32 and of the coaxial insulation 34 in the region of the cut-out 33. The inner conductors 31 and 32 are here extended over the lower end of the insulation 34 and their lower ends can pass through bores in a circuit board to which they are soldered. The grounding of the antenna takes place separately in this embodiment, for example, via a solder pin that is arranged at the antenna body, in particular at the pedestal, and that is soldered to the circuit board.

Figure 15B:
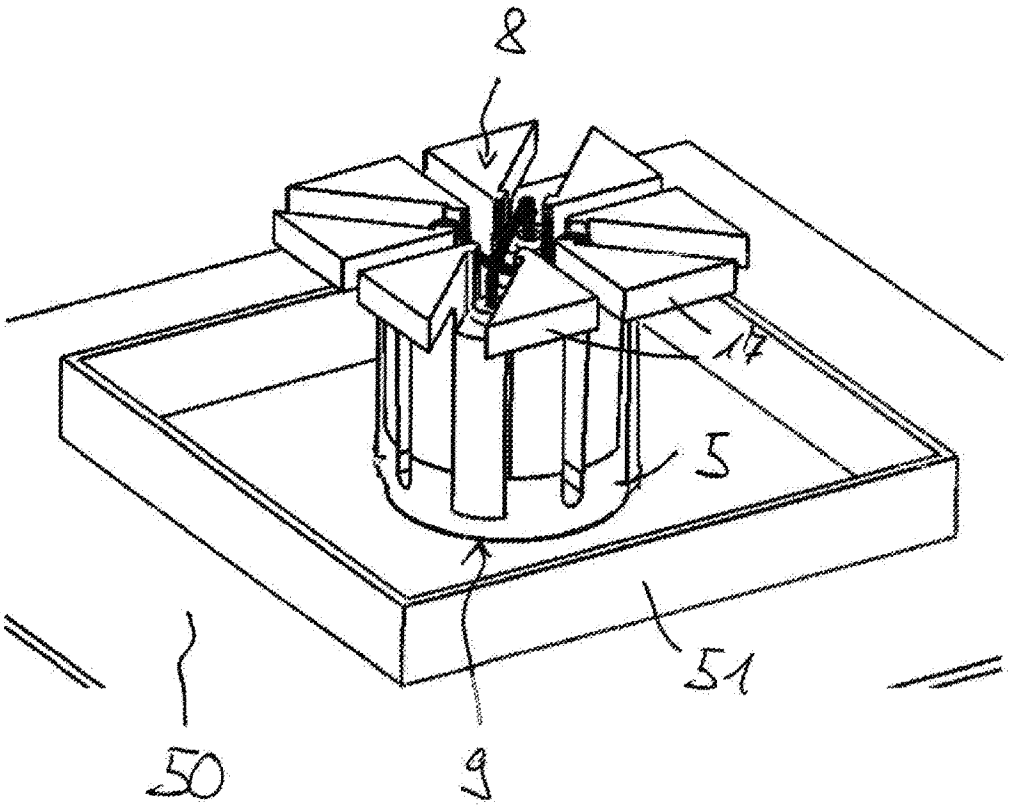
FIG. 15B shows an embodiment of an antenna arrangement in accordance with the invention in which the antenna in accordance with the invention is arranged on a reflector.
Figure 15A:
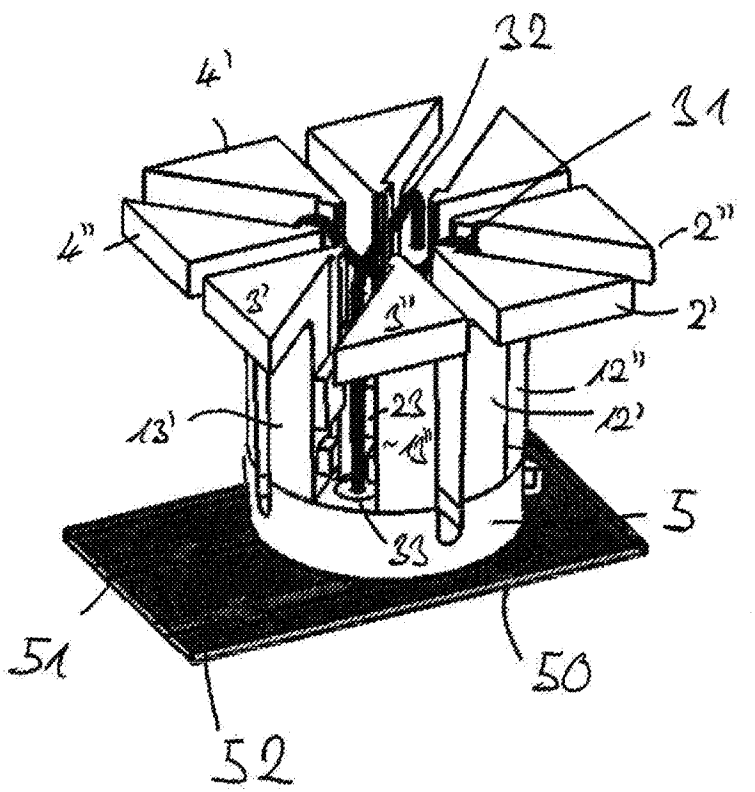
FIG. 15A shows an embodiment of an antenna arrangement in accordance with the invention in which the antenna in accordance with the invention is arranged on a circuit board.

A corresponding embodiment of an antenna arrangement is shown in FIG. 15A in which the antenna is connected to a circuit board 50 via the coaxial feed elements shown in FIG. 14. The lower side 9 of the antenna, i.e. the pedestal 5, here lies on the upper side of the circuit board 50. The feed-side ends of the coaxial feed elements 31 and 32 pass through bores in the circuit board and are soldered to microstrip lines 51 and 52 respectively at the lower side of the circuit board. The antenna pedestal furthermore preferably has a ground pin by which it is soldered to a ground surface of the circuit board. The soldering can here take place at the upper side of the circuit board.

In the embodiment shown, the conductors 31 and 32 end in an upper region of the slots disposed opposite the feed side.

In an alternative embodiment, not shown, however, the ends of the coaxial feed elements disposed opposite the feed side could also be led downwardly through the pedestal to the base region 6 and through bores 33 there. The inner conductors would accordingly also have insulations 34 at the oppositely disposed sides where they pass through the bore. The inner conductors can here be soldered to a ground of a circuit board at the side disposed opposite the feed side.

In a further alternative embodiment, not shown, the ends of the coaxial feed elements disposed opposite the feed side could also be galvanically coupled to the dipole elements or to the support elements.

An arrangement of an antenna in accordance with the invention on a reflector 50 is shown in FIG. 15B. The reflector 50 here has a base plate that stands perpendicular on the center axis of the antenna and thus extends in parallel with the main plane of the dipole elements. The spacing between the plane of the base plate of the reflector 50 and the upper side of the antenna formed by the dipoles in the embodiment preferably amounts to:

$$X+L=0.25\lambda\pm0.2\lambda,$$

where $\lambda$ is the wavelength of the center frequency of the antenna. In other embodiments, the spacing can, however, also be selected as larger to achieve a different radiation characteristic. The spacing could, for example, also be at $0.5\lambda\pm0.1\lambda$.

In the embodiment shown in FIG. 15B, the reflector furthermore has a reflector frame 51 that is arranged around the antenna. The reflector frame here likewise has a square base surface, with the sides of the square frame 51 being aligned in parallel with the outer sides 17 of the dipole square. The reflector frame 51 thus has the same alignment as the dipole square. In other embodiments, the reflector frame can also have a different shape or can comprise further reflector elements, for example wings arranged at the reflector frame.

The arrangements of an antenna in accordance with the invention on a circuit board or on the base plate of a reflector, shown in FIG. 15A and FIG. 15B, can here be used independently of the specific design of the antenna in accordance with the invention or of the feed. The embodiment shown in FIGS. 1 to 3 can in particular be used here.

However, two modifications of this embodiment in which a plurality of different possibilities of adaptation of the antenna are shown are already presented in FIG. 15A and FIG. 15B. They will be explained again in more detail with reference to FIG. 16A and FIG. 16B.

Figure 16B:
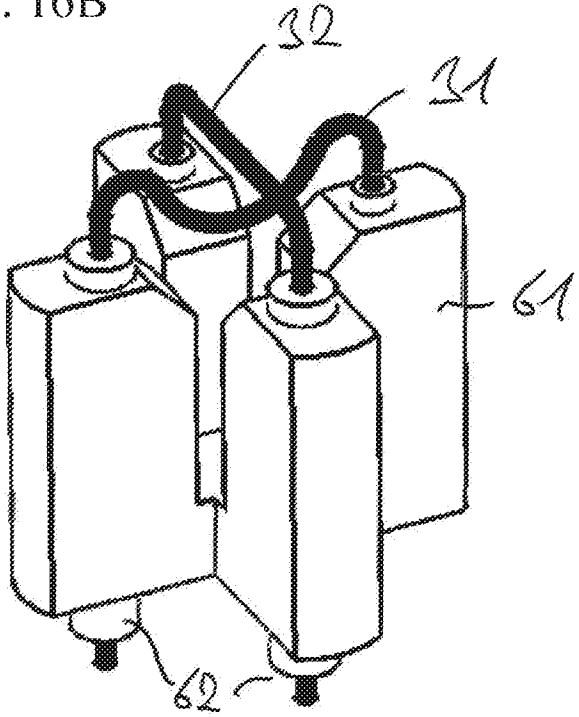
FIG. 16B shows a further alternative embodiment of an antenna in accordance with the invention in which the feed conductors are guided in dielectric blocks in the slots.
Figure 16A:
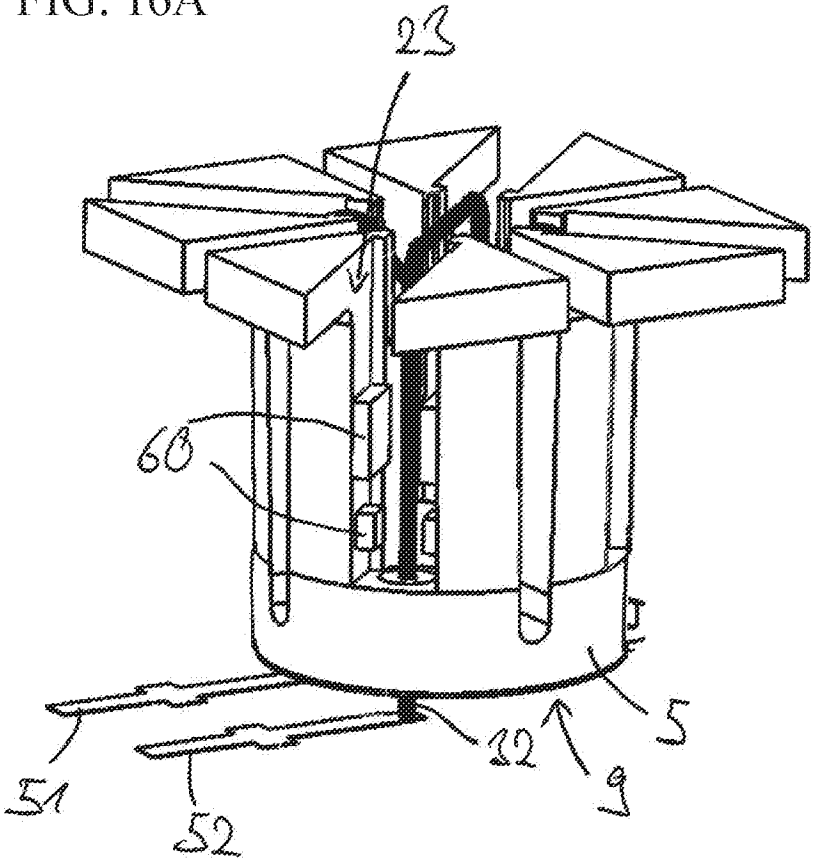
FIG. 16A shows an alternative embodiment of an antenna in accordance with the invention in which the slots in the support elements have irregular widths.

In the embodiment of an antenna shown in FIG. 16A which is also used in FIG. 15A, tapering elements 60 which change the width of the gap are arranged in the gap 23. The tapering elements are here arranged in the region of the feed slot in which the feed conductor 32 extends, i.e. between two sections of a support element. An adaptation of the antenna can take place by the varying width of the gap.

In FIG. 16B, in contrast, an alternative possibility is shown to guide the feed conductors 31 and 32 in the slots. The conductors 31 and 32 here extend through dielectric bodies 61 that are arranged in the volume of the slots of the support elements and that fill them in the embodiment. The electrical bodies 61 have extensions 62 of hollow cylindrical shape at their lower side and can be inserted by them into the cut-outs 33 at the base of the slots and via which the conductors are insulated with respect to the pedestal. In the embodiment, a contiguous dielectric body is used here that fills all four slots. However, a variety of alternative embodiments are also conceivable. The shape of the conductors 31 and 32 can correspond to the shape shown in FIG. 14 and described above.

Figure 17:
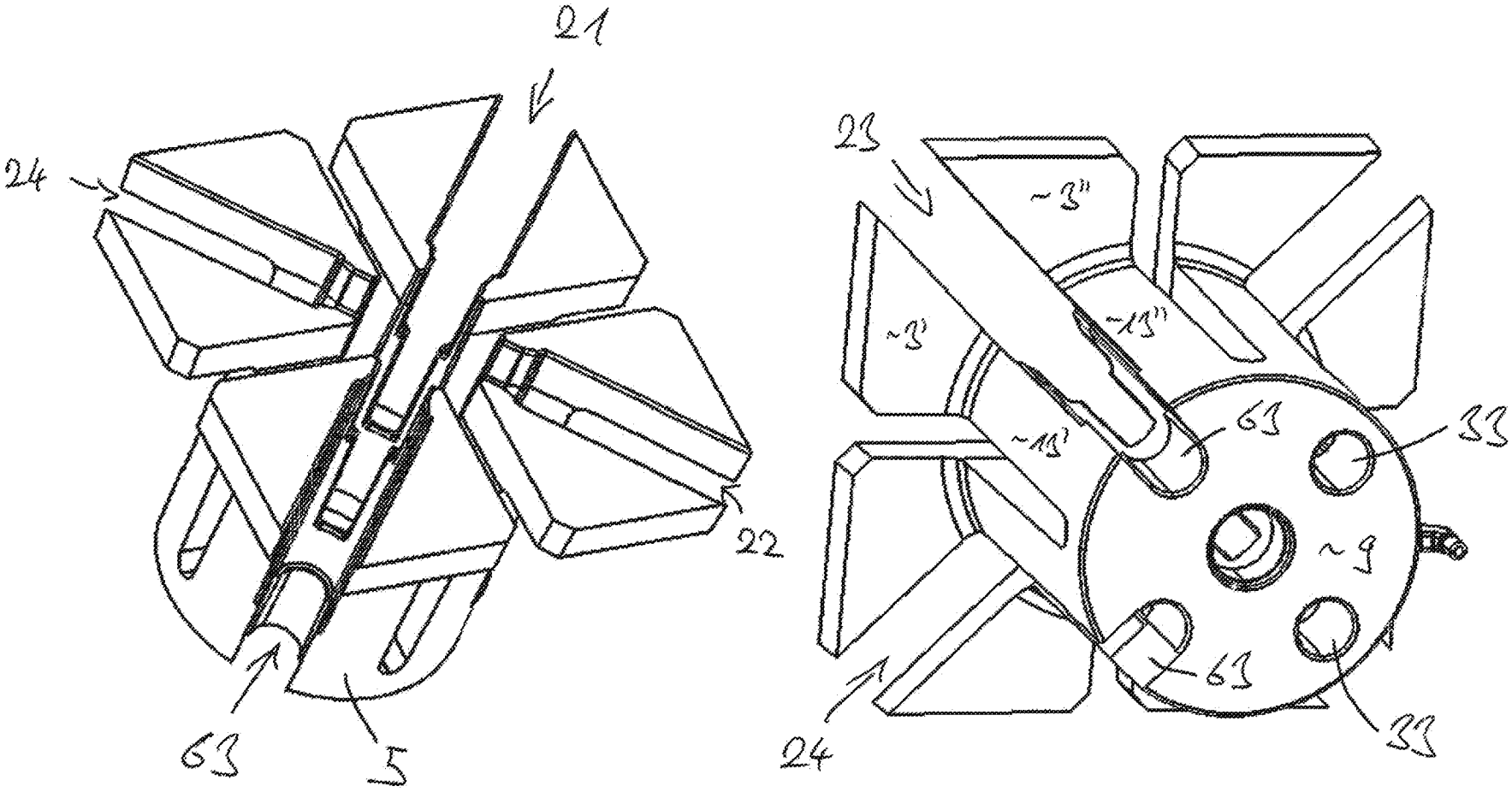
FIG. 17 shows a third embodiment of an antenna in accordance with the invention in a perspective representation obliquely from above and obliquely from below, with the feed conductors in this embodiment being able to be installed via a groove at the pedestal of the antenna open toward the side.

A third embodiment of an antenna in accordance with the invention is shown in FIGS. 17 and 18. With respect to its general design, the embodiment corresponds to the embodiment already shown in FIGS. 1 to 3 so that reference is made to the above description in this respect. Only the differences of the embodiment shown in FIGS. 17 and 18 with respect to the embodiment shown in FIGS. 1 to 3 will be discussed in more detail in the following. The embodiment shown in FIGS. 17 and 18 enables a different installation of the conductors 31 and 32 with respect to the embodiment shown in FIGS. 1 to 3.

For this purpose, the slots 23 and 24 of the support elements 13 and 14 in which the conductors 31 and 32 extend on the feed side have grooves 63 which are outwardly open in their base region and into which the conductors 31 and 32 can be laterally inserted.

In the third embodiment, the conductors 31 and 32 in a first variant are formed by the pre-bent ends of coaxial cables 71 and 72 freed from the outer conductor or in a second variant are designed as pre-bent inner conductors of coaxial feed elements. In the region of the grooves 63, the conductors 31 and 32 here each have outer conductors 73 and 74 respectively whose upper end electrically forms the base of the slots 23 and 24 respectively.

In accordance with the first variant, the conductors 31 and 32 are the ends of the inner conductors of coaxial cables in which the outer conductor or the shielding of the coaxial cable was removed. In the embodiment, the dielectric sleeve around the inner conductor has also been removed.

In the region of the groove 63, the coaxial cable still has its outer conductor 73 and 74 respectively that is preferably electrically coupled to the antenna body within the groove. In a first embodiment, the outer conductor can be exposed in the region of the groove for this purpose and can thus directly contact the inner surface of the groove 63. The coupling takes place galvanically in this case. In a second variant, the coaxial cable further has its outer insulation in the region of the groove 63 and is capacitively connected to the groove there. Alternatively, the outer conductor can, however, also be coupled to the antenna body, in another manner, for example by a soldered connection.

In accordance with the second variant, the feed conductors 31 and 32 are the inner conductors of coaxial feed elements that each have a coaxial plug-in connector for the connection of a coaxial cable at the feed side. The coaxial feed elements otherwise have the same design that was described above with respect to the first variant. An outer conductor 73 and 74 respectively of the coaxial feed element can in particular also be capacitively or galvanically coupled to the groove in this case.

Figure 18B:
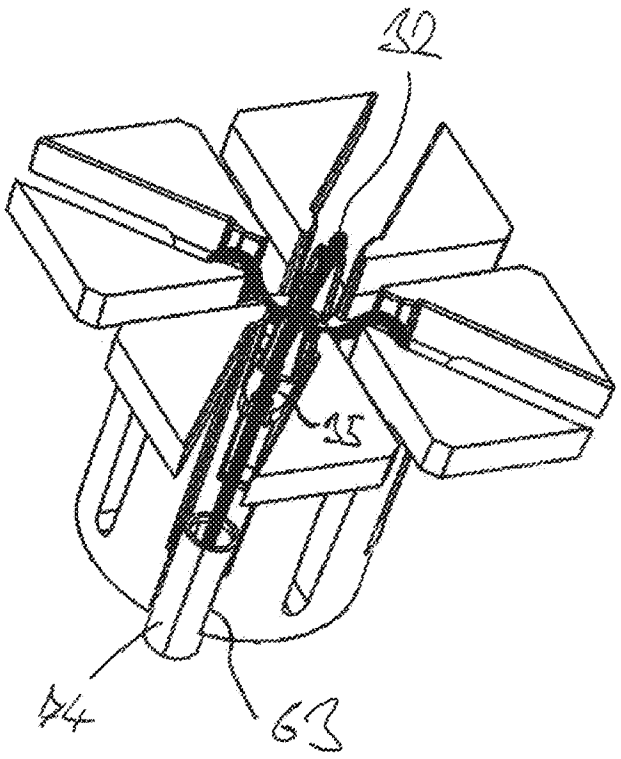
FIGS. 18A and 18B show the installation of the conductors in the third embodiment of an antenna in accordance with the invention shown in FIG. 17.
Figure 18A:
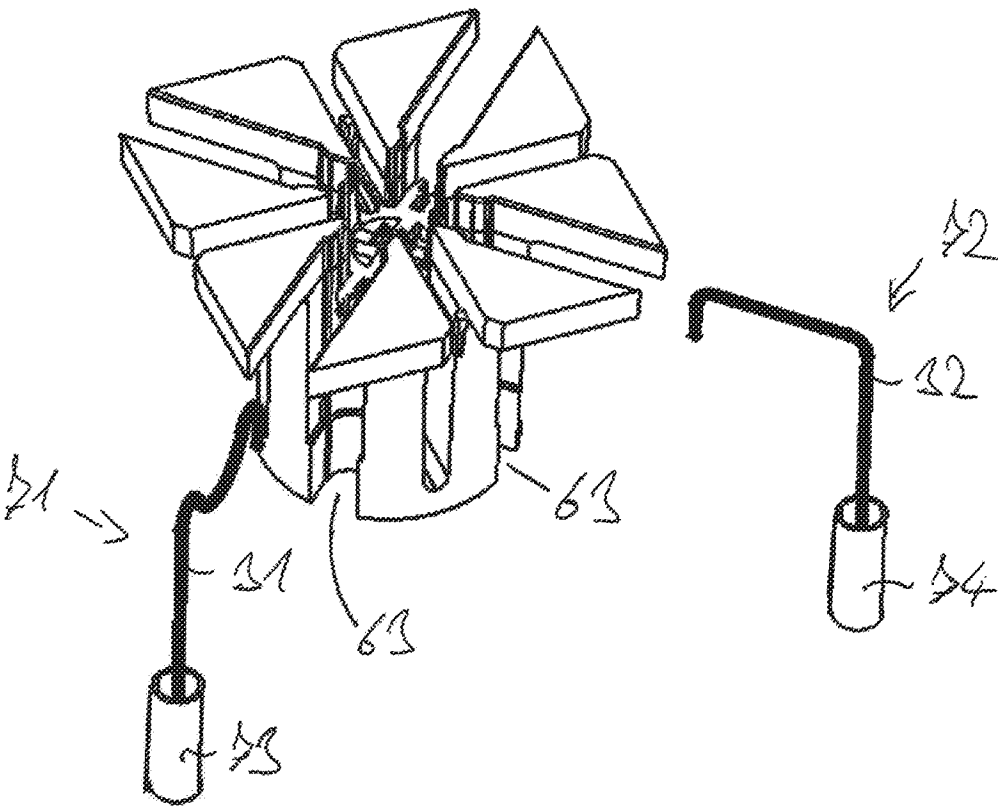

As shown in FIG. 18A and FIG. 18B, the conductors 31 and 32 can be installed at the antenna body such that they are laterally inserted into the grooves 63 with the regions 73 and 74. An installation of the feed is hereby at least possible without a soldering of the inner conductors 31 and 32. Optionally, as described above, a soldering of the outer conductor can also be dispensed with as described above. In an alternative embodiment, however, the outer conductor can be coupled to the antenna body by a soldered connection. The inner conductors 31 and 32 are preferably pre-bent here and are held in the gaps via the dielectric holder 35.

In the third embodiment shown in FIGS. 17 and 18, the groove 63 extends the slots 23 and 24, and indeed downward through the pedestal. In the installed state of the feed, however, the outer conductors 73 and 74 form the base region 6 of the slot. The length of the slot L is therefore determined in the embodiment shown in FIGS. 17 and 18 upward starting from the upper edge of the outer conductors 73 and 74 respectively.

This can in particular be used in an antenna arrangement independently of the specific embodiment of the antenna. An antenna arrangement in accordance with the invention here comprises at least one antenna in accordance with the invention, but preferably a plurality of antennas in accordance with the invention, that is/are arranged on one or more reflectors. A plurality of antennas in accordance with the invention are here preferably arranged on a common installation plate with the same alignment and form an antenna arrangement in accordance with the invention.

The invention claimed is:

1. A dual polarized antenna, comprising:

four dipole elements of which each is arranged at an associated support element, wherein a slot is provided in a volume of each dipole element and is extended from the dipole element into the associated support element, wherein the four dipole elements are dipole halves, with two first dipole elements out of the four dipole elements together forming a first dipole of the antenna and two second dipole elements out of the four dipole elements together forming a second dipole of the antenna, wherein the dipole elements form a dipole square whose diagonals are defined by polarization planes of the first and second dipoles, with the slots in the volume of the dipole elements extending along the diagonals of the dipole square;

wherein the slots of oppositely disposed dipole elements and support elements extend in the same plane; and wherein the slots of adjacent dipole elements extend in planes standing orthogonally on one another;

and wherein the slots in the volume of the dipole elements and the slots in the volume of the support elements each extend along the polarization planes of the antenna.

2. The dual polarized antenna in accordance with claim 1, wherein the support elements extend upward separately from a pedestal of the antenna and the dipole elements extend outwardly from an upper end of the support elements.

3. The dual polarized antenna in accordance with claim 1, wherein a respective slot arranged in the volume of the dipole element and of the associated support element forms a slot radiator.

4. The dual polarized antenna in accordance with claim 1, wherein the slots extending in the volume of the support elements and of the dipole elements have a total length, measured respectively along a radial outer edge of the support element and an upper edge of the dipole element; between 0.3λ and 0.7λ, with λ being a wavelength of a center frequency of a lowest resonant frequency range of the antenna.

5. The dual polarized antenna in accordance with claim 1, wherein at least one out of the following applies:

the slots pass through the dipole elements in a vertical direction extending along a polarization plane of the respective dipole element;

the slot extending in the volume of the dipole element and of the associated support element has a substantially constant width over its extent and passes through the dipole element in a direction that extends along the polarization plane of the respective dipole element.

6. The dual polarized antenna in accordance with claim 1, wherein a feed of the antenna comprises a conductor that extends at least partly into one of the slots extended into the volume of the support element.

7. The dual polarized antenna in accordance with claim 6, wherein at least one out of the following applies:

the conductor of the feed enters into the slot at a feed side in a base region of the slot and extends upward in the slot from the base region;

the conductor extends from a first slot in the volume of a first support element to an oppositely disposed second support element;

the conductor first extends upward in the first slot and then inwardly via an angled portion from where the conductor extends into a second slot; and the conductor is held in the slot by a dielectric holder.

8. The dual polarized antenna in accordance with claim 6, wherein at least one out of the following applies:

side walls of the slot in which the conductor extends have cut-outs or elevated portions;

the conductor has different diameters over its extent;

one or more dielectric elements are arranged in the slot in which the conductor extends;

a feed line toward the antenna has a matching circuit.

9. The dual polarized antenna in accordance with claim 6, wherein the feed of the antenna takes place via a coaxial cable whose one end does not have any shielding, with an inner conductor remaining there extending at least partially in a slot in the volume of a support element;

or wherein the feed of the antenna takes place via a coaxial feed element whose one end does not have any shielding, with an inner conductor remaining there extending at least partially in a slot in the volume of a support element and whose other end comprises a plug-in connector for connecting a coaxial cable;

or wherein the feed of the antenna takes place via the coaxial feed element whose one end does not have any shielding, with an inner conductor remaining there extending at least partially in a slot in the volume of a support element and whose other end is soldered to a circuit board on which the antenna is arranged.

10. The dual polarized antenna in accordance with claim 9, wherein the inner conductor is pre-bent and the coaxial cable or the coaxial feed element is laterally clippable into a groove of a pedestal of the antenna open toward one side or insertable into an axial bore of the pedestal.

11. The dual polarized antenna in accordance with claim 1, wherein an antenna body is designed in one piece;

wherein the antenna body is produced from plastic, with the antenna body comprising at least one out of a conductive plastic, and a conductive layer coating, and with the antenna body being manufactured by an injection molding process.

12. An antenna arrangement having at least one dual polarized antenna in accordance with claim 1, wherein a pedestal of the antenna is arranged on a reflector, with the reflector having a base plate that extends in a plane that extends perpendicular to a center axis of the antenna.

13. The dual polarized antenna in accordance with claim 1, wherein the first dipole elements are disposed opposite with respect to a center axis of the antenna from the first dipole, and the two second dipole elements are disposed opposite with respect to the center axis of the antenna from the second dipole, with polarization planes of the first and second dipoles of the antenna extending orthogonally.

14. The dual polarized antenna in accordance with claim 13, wherein polarization planes of slot radiators formed by the slots are parallel to the polarization planes of the dipoles in whose volume they are not arranged.

15. The dual polarized antenna in accordance with claim 13, wherein the slots provided in the volume of the dipole elements and extended from the dipole elements into the associated support elements are first slots, and four support elements are separated from one another by second slots.

16. The dual polarized antenna in accordance with claim 1, wherein a region of the slots extending in the volume of the support elements has a length, respectively measured from an upper edge of the antenna up to an end of the slot, between $0.1\lambda$ and $0.4\lambda$, with $\lambda$ being a wavelength of a center frequency of a lowest resonant frequency range of the antenna.

17. A dual polarized antenna, comprising:

four dipole elements of which each is arranged at an associated support element, wherein a slot is provided in a volume of each dipole element and is extended from the dipole element into the associated support element, wherein a feed of the antenna comprises a conductor that extends at least partly into one of the slots extended into the volume of the support element, wherein the feed comprises two separate conductors for feeding of two polarizations, the two separate conductors extending in a crossed manner with respect to one another, and wherein the conductors each feed a dipole in whose volume they are arranged and each feed a slot radiator that is formed by the slots in the volume of the dipole elements extending diagonally thereto.

18. A dual polarized antenna, comprising:

four dipole elements of which each is arranged at an associated support element, wherein a slot is provided in a volume of each dipole element and is extended from the dipole element into the associated support element, wherein a feed of the antenna comprises a conductor that extends at least partly into one of the slots extended into the volume of the support element, wherein the feed takes place via an inner conductor of at least one out of a coaxial cable and of a coaxial feed element that extends within a slot in a support element, with a pedestal of the antenna having a cut-out for inserting the coaxial cable or the coaxial feed element in a base region of the slot.

19. The dual polarized antenna in accordance with claim 18, wherein an outer conductor of the at least one out of the coaxial cable and of the coaxial feed element is galvanically or capacitively coupled to the pedestal in the cut-out; or wherein the pedestal is coupled outside the cut-out to the outer conductor or ground.

* * * * *